US006161242A

United States Patent [19]

Cabrero Gomez et al.

[11] Patent Number: 6,161,242

[45] Date of Patent: Dec. 19, 2000

[54] MOPS

[75] Inventors: Estrella Cabrero Gomez; Juan Jose Celada Gutierrez; Alfonso Guillen Lopez; Felipe Barandiaran Aldasoro; Carmen Martin Rivera, all of Madrid, Spain

[73] Assignee: 3M Innovative Properties Company, Saint Paul, Minn.

[21] Appl. No.: 09/000,073

[22] PCT Filed: May 10, 1996

[86] PCT No.: PCT/EP96/01982

§ 371 Date: Jul. 21, 1998

§ 102(e) Date: Jul. 21, 1998

[87] PCT Pub. No.: WO97/06722

PCT Pub. Date: Feb. 27, 1997

[30] Foreign Application Priority Data

Aug. 18, 1995 [EP] European Pat. Off. ..... 95202243

[51] Int. Cl.[7] ..... A47L 13/20; A47L 13/21

[52] U.S. Cl. ..... 15/147.1; 15/150; 15/229.1; 15/229.2; 15/228

[58] Field of Search ..... 15/229.1, 229.2, 15/229.3, 228, 178, 145, 176.1, 176.6, 177, 150, 147.1, 147.2, 151, 146

[56] References Cited

U.S. PATENT DOCUMENTS

| | | | |
|---|---|---|---|
| 53,576 | 4/1866 | Clay . | |
| 53,654 | 4/1866 | Mumma | 15/178 |
| 704,483 | 7/1902 | Mansfield . | |
| 1,493,848 | 5/1924 | Ebert . | |
| 2,501,514 | 3/1950 | Hill | 15/150 |
| 3,399,499 | 9/1968 | Stetz et al. | 15/150 |
| 3,417,420 | 12/1968 | Rock . | |
| 4,114,224 | 9/1978 | Disko | 15/229 |
| 4,553,282 | 11/1985 | Batchelor | 15/150 |
| 4,811,445 | 3/1989 | Lagieski et al. | 15/145 |
| 5,221,124 | 6/1993 | Nichols | 300/21 |

FOREIGN PATENT DOCUMENTS

| | | |
|---|---|---|
| 0 537 963 A1 | 10/1992 | European Pat. Off. . |
| 2271795 | 12/1975 | France . |
| 291766 | 7/1915 | Germany . |
| 162946 | 7/1933 | Switzerland . |
| 376170 | 12/1931 | United Kingdom . |
| 2191937 | 12/1987 | United Kingdom . |
| 92/14064 | 8/1992 | WIPO . |

*Primary Examiner*—Gary K. Graham
*Attorney, Agent, or Firm*—Michaele A. Hakamaki

[57] ABSTRACT

A strip mop has a head (101) comprising a holder (103) which is attached to the mop handle (104) and in which a replaceable strip assembly (126, FIG. 21) is located. The strip assembly is formed from layers of absorbent web material cut into strips (102) over part of their length, the uncut parts being located in the holder (103). When the strips (102) become worn, the holder (103) is opened (FIG. 18) so that the strip assembly (126) can be removed and replaced by another.

6 Claims, 22 Drawing Sheets

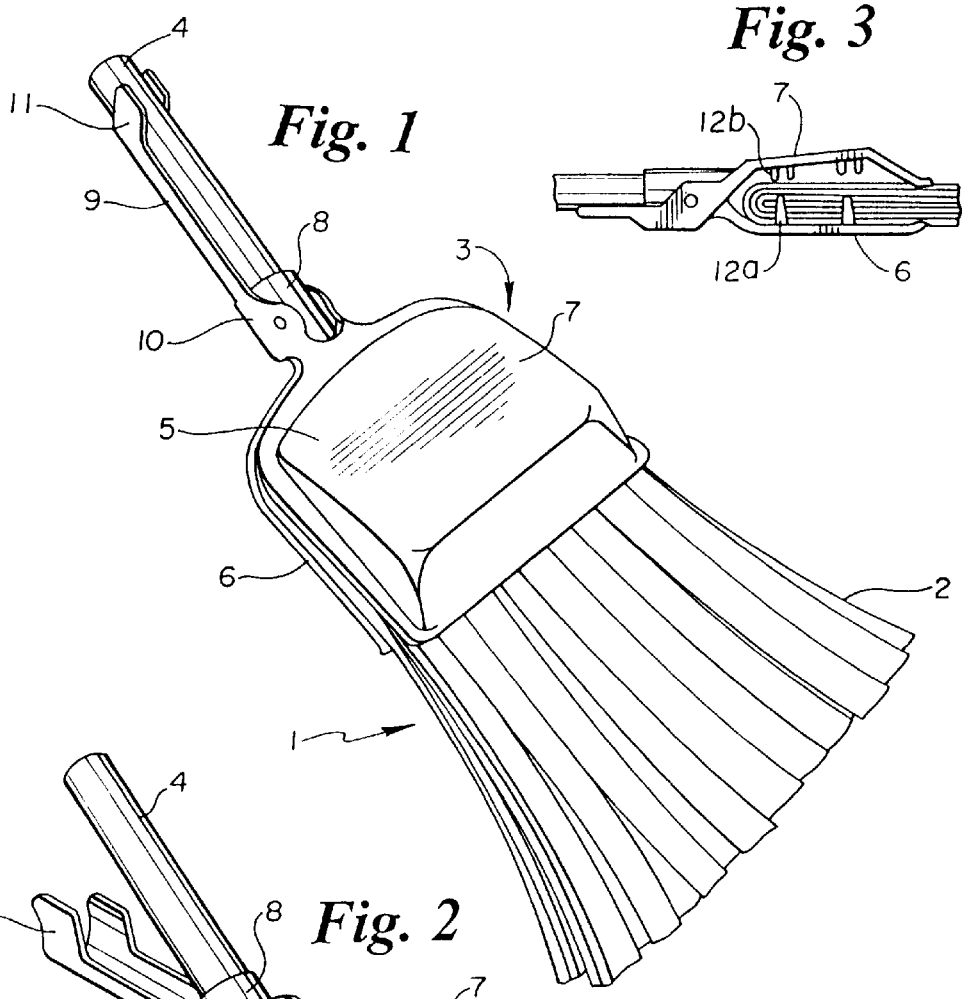
Fig. 1
4
11
9
8
3
10
7
5
6
2
1
Fig. 3
7
12b
12a
6
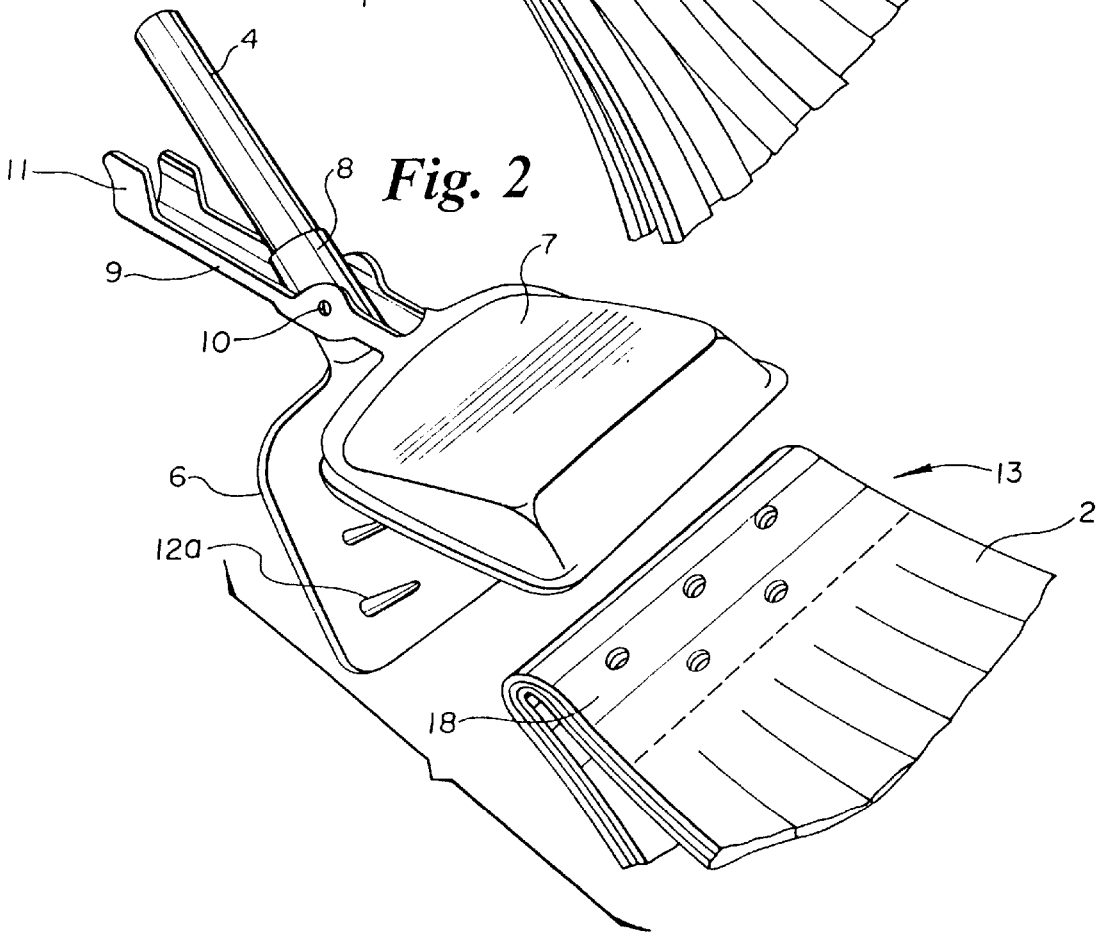
Fig. 2
4
11
8
9
7
10
6
13
2
12a
18

MOPS

BACKGROUND OF THE INVENTION

The present invention relates to mops, more especially (but not exclusively) to mops which are suitable for domestic cleaning purposes.

Various types of mop are available for domestic cleaning. They all comprise a stick-like handle to which some form of cleaning head is attached. In one particular type of mop (commonly known as a strip mop), the head comprises strips of an absorbent material typically about 20 cms long. In a known type of strip mop, intended for use as a floor mop, the strips are secured in a hemispherical holder (usually formed from a plastics material) which has a cylindrical, recessed, extension into which the mop handle can be fitted. Strip mops of that type are described in U.S. Pat. No. 4,114,224 and EP-A-0 537 963. When the strips become worn, the whole head (comprising the strips and the hemispherical holder) is disposed of and replaced by a new one. Such replacement heads, because of their shape, are comparatively awkward to package and handle, giving rise to problems and increased costs associated with storage and transportation. In addition, disposal of a worn head requires disposal not only of the strip material but also of the holder in which the strips are secured and which, often, will not be worn. The disposal of an entire item in that way, particularly one which is composed of mixed materials, is undesirable on environmental grounds.

A similar type of mop, which has textile strands instead of strips, is described in GB-A-2 255 712.

A known mop for industrial cleaning has a head which comprises an assembly of heavy-weight cotton strings held together by a strip of material to which the strings are secured by stitching. The string assembly is clamped in a holder at one end of the mop handle and can be removed and replaced when it becomes worn. Another known mop of that type is described in U.S. Pat. No. 4,531,251. Similar assemblies formed from non-woven fabrics instead of cotton strings have also been proposed, and one is described in the above-mentioned U.S. Pat. No. 4,114,224.

There is also known, from FR-A-943 666, a cleaning brush having a replaceable head which is formed by a plurality of pieces of fabric The fabric pieces are held in place, at one end of the handle of the brush, by a rod which extends lengthwise of the handle and is secured at the other end.

Another type of mop for domestic cleaning (commonly known as a sponge mop) has a cleaning head which comprises a rectangular piece of sponge material and, with some mops of that type, it is only the sponge material that needs to be replaced. The sponge material may, for example, be releasably-held by clips on a rectangular backing which forms a permanent part of the mop. Alternatively, in a known mop for cleaning windows, the sponge material is releasably-held in a pair of clamping jaws which form a permanent part of the mop.

From the point of view of a user, a strip mop has the advantage that, after it has been used for washing a surface, it can be rinsed and wrung out very effectively and used to dry the surface that has just been washed. The same degree of cleanliness and dryness is often difficult to achieve with other forms of mop, and especially with sponge mops.

SUMMARY OF THE INVENTION

The present invention is concerned with providing an improved mop of the strip mop type and, in particular, with providing a mop with a head which can be renewed at lower cost and with less wastage of materials than at present.

The present invention provides a replaceable assembly for insertion in a releasable holder to form a mop head, the assembly being packaged and comprising at least one layer of web material part of which forms a working portion for a mop head, the layer having at least one aperture for locating the layer in the releasable holder.

The present invention also provides a replaceable assembly for insertion in a releasable holder to form a mop head, the assembly comprising: at least one layer of web material part of which forms a working portion for a mop head, the layer having at least one aperture for locating the layer in the releasable holder; and, in combination with the layer, printed instructions for locating the layer in a releasable holder of a mop head.

The present invention further provides a replaceable assembly for insertion in a releasable holder to form a mop head, the assembly comprising at least two elongate layers of web material arranged to extend in different directions with the central parts of the layers being located one on top of another and secured together, each end of each layer forming a working portion for a mop head.

A replaceable assembly in accordance with the invention may be inserted in a releasable holder to form a mop head for attachment to a mop handle.

In accordance with the invention, a mop head holder comprises two parts which are releasably-engageable one within the other to releasably secure, between the two parts, a replaceable assembly comprising a plurality of layers of web material. The holder may have a cylindrical extension for engagement with a mop handle. The extension may be shaped to be screwed and/or pushed and/or clipped to a mop handle.

BRIEF DESCRIPTION OF THE DRAWINGS

By way of example only, strip mops in accordance with the invention will be described with reference to the accompanying drawings, in which:

FIG. 1 is a perspective view of a strip mop;

FIG. 2 is a perspective view, similar to FIG. 1, but showing the replaceable part of the mop removed from the mop handle;

FIG. 3 is a side view of part only of the mop head;

DETAILED DESCRIPTION OF THE PREFERRED EMBODIMENT

Figure 4:
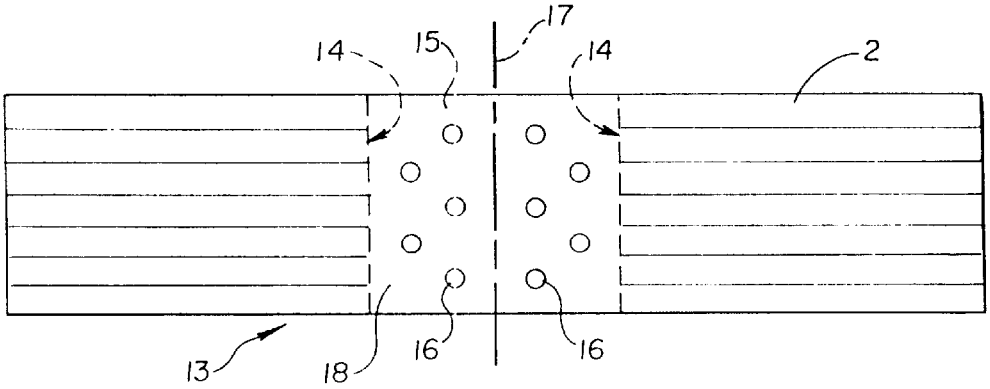
FIG. 4 shows the replaceable part of the mop in an opened-out condition.

The mop shown in FIG. 1 is a floor mop and has a head 1 comprising a plurality of fabric strips 2 secured in a holder 3 at one end of a stick-like handle 4 (only part of which is shown). The strips 2 are formed from a conventional non-woven absorbent material, for example a thermo-bonded non-woven material or a coated non-woven material, and extend from the holder 3 for about 20 cms. The use of a non-woven absorbent material is not essential, however, and the strips could be formed from any other suitable material, for example (in the case of a floor mop), an absorbent extruded web material or a cellulosic sponge material. The strips 2 are a replaceable part of the mop, as will be described in greater detail below. The holder 3, on the other hand, is a permanent part of the mop, as is the handle 4. The holder 3, which will also be described in greater detail below, is formed from a plastics material (for example polypropylene filled with glass fibre), while the handle 4 is a conventional mop handle, about 120 cms long and formed, for example, from wood or a metal (which may be covered with a plastics material).

The holder 3 comprises a main body portion 5 which is formed in two halves 6, 7, (shown closed in FIG. 1 and open in FIG. 2). The two halves 6, 7, are shaped so that when they are closed together, they define an enclosed space in which the upper part of the mop strips 2 can be located. Each half of the body portion 5 is generally rectangular in outline but the half 6 has a cylindrical extension 8 in which the end of the handle 4 is securely fitted while the other half 7 is formed with a lever portion 9 which is used to open and close the holder 3 as will be described below. The body half 7 is pivotally connected to the body half 6 by pins 10, one on each side of the handle 4, which pass through the lever portion 9 and into the cylindrical extension 8.

The lever portion 9 of the holder 3 is curved so that it will fit closely adjacent the mop handle 4 when the holder is closed, as shown in FIG. 1. The free end of the lever portion 9 has locking extensions 11 which are shaped so that they tightly engage the handle 4 when the lever portion is pushed against the latter, and so retain the holder 3 in the closed condition. When it is required to open the holder 3, sufficient force must be exerted to pull the locking extensions 11 of the lever portion 9 away from the handle 4, whereupon the lever portion 9 can be used to pivot the body half 7 away from the body half 6 as shown in FIG. 2.

On the inside surface of the body half 6 are a series of pins 12*a* (FIG. 2), the purpose of which will be described below. When the holder 3 is closed, the pins 12*a* engage in respective sockets 12*b* on the inside surface of the body half 7. The sockets 12*b* are not visible in FIG. 2 but two of them appear in FIG. 3.

The mop strips 2 are provided by a generally rectangular assembly 13 which forms a replaceable part of the mop. The assembly 13 comprises several layers of material, each of an elongate rectangular shape, arranged one on top of each other and secured together, for example by stitching along two, spaced apart, lines 14 across the width of the rectangles as shown in FIG. 4. The strips 2 are cut into the layers, from the ends of the rectangles inwards towards the stitching lines 14 leaving the region 15 between the stitching lines uncut. Holes 16 are also cut through the layers of material in the region 15, in locations which (about a line 17 parallel to and halfway between the stitching lines 14) correspond to the locations of the pins 12*a* in the holder 3. The resulting assembly 13 is then folded in half along the line 17 so that it has the form shown in FIG. 2 (that is an upper uncut portion 18 which contains the holes 16 and from which the strips 2 extend). A comparable strip assembly could, of course, be formed by folding the individual layers before they are stitched together, in which case only one line of stitching would be required.

The assembly 13 is inserted, fold first, into the open holder 3 and the uncut portion 18 is positioned within the holder 3 so that the pins 12*a* are located in the holes 16. The lever portion 9 is then moved towards the handle 4 to engage the latter between the locking extensions 11 and so secure the holder 3 in the closed position with the replaceable assembly 13 clamped inside it and held by the pins 12*a*, the ends of which are now located in the corresponding sockets 12*b*. The mop is then ready for use. If the strips 2 should become worn, it is necessary only to open the holder 3, remove the assembly 13 and replace it with a new one. Alternatively, if the strips are not worn but only dirty, the replaceable assembly can be washed and re-used.

Figure 5:
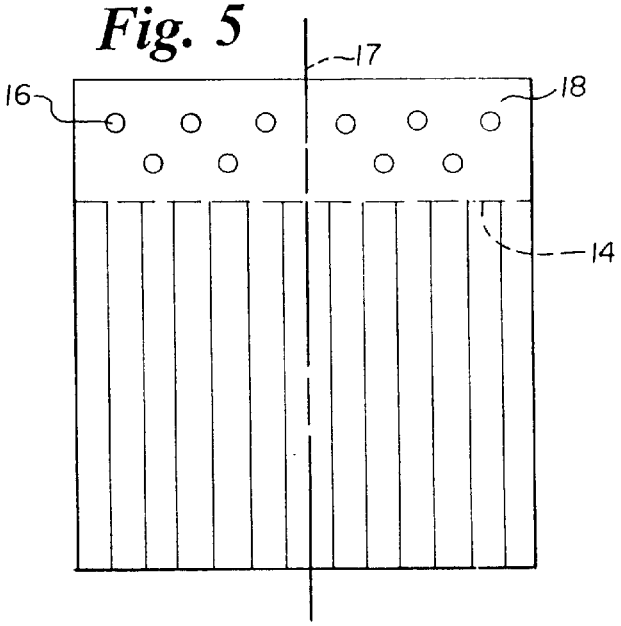
FIGS. 5 and 6 show alternative forms of the replaceable part for the mop shown in FIG. 1.
Figure 6:
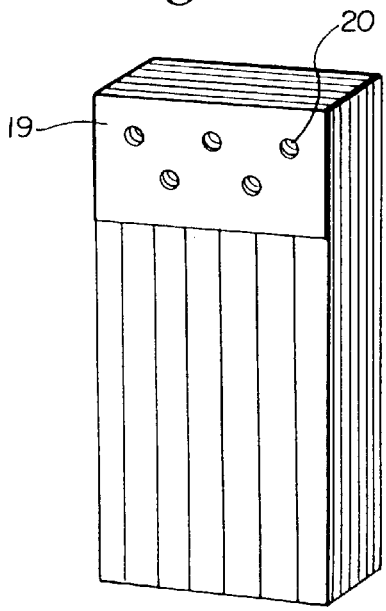

The replacement assemblies 13 for the mop shown in FIG. 1 could be available to a user either flat, as shown in FIG. 4, or already folded, as shown in FIG. 2, and could be packaged either individually or several together. It is, however, not essential for the replaceable assembly 13 to be of the form shown in FIG. 4. An alternative replaceable assembly, which also must be folded before being inserted in the holder 3, is shown in FIG. 5. In that case, each layer of material is cut into strips 2 from one side only, leaving an uncut portion 18 (in which the holes 16 are formed) along the other side of the layer. The assembly is folded in half along line 17 before being inserted in the holder 3. However, though the use of a folded assembly requires the use of fewer layers of material to form the assembly, the folded region itself is of increased thickness and may be difficult to insert in the holder 3. As a further alternative, therefore, the replaceable assembly need not be folded but could simply comprise one half of the assembly shown in FIG. 4 (i.e. terminating at the halfway line 17): in that case, however, the assembly would need to be formed using a greater number of layers of material, or two (or more) replaceable assemblies would have to be used in the mop at any one time. As yet another alternative, instead of being stitched together, the various layers of material could be held together by some form of casing around the uncut portions 18 of the layers. One suitable form of casing, which does not cover the side edges of the uncut portions 18, is shown in FIG. 6 and indicated by the reference numeral 19. The casing must of course, be provided with holes 20 corresponding in location to the holes 16 in the layers of material.

In each of the replaceable assemblies shown in FIGS. 2 to 6, the portions 18 that are releasably secured in the holder 3 are part of the same layer of material as the strips 2. That is not essential, however, and the uncut portions 18 of the layers could be formed from a different material to that of the strips 2. Alternatively, a replaceable assembly could comprise a single uncut portion 18 common to all the layers of strips.

Figure 57:
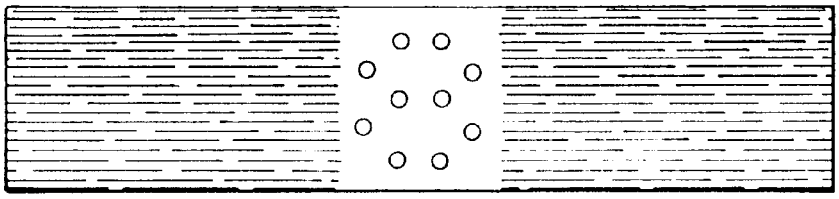

In the description of the replacement assemblies so far, it has been assumed that the layers of absorbent material are cut into what may be referred to as "continuous strips". It is, however, possible (and in some case may be preferable) to cut the layers of absorbent material in some alternative fashion. For example, U.S. Pat. No. 4,288,884 describes strip assemblies in which layers of absorbent material are cut, not into continuous strips, but in a pattern of slits (so-called "skip slits") which has the effect of forming a lattice in the absorbent material. It should be understood that any of the replacement layers already described could be cut in that way, instead of being cut into continuous strips and that the same applies to any of the replacement layers described below. FIG. 57 shows, by way of example, a replacement layer of the type shown in FIG. 4 in which the continuous strips 2 of the latter are replaced by a pattern of slits as described in U.S. Pat. No. 4,288,884. It should also be understood that the replacement layers can, in fact, be cut or shaped in any other way suitable for providing the working portion of a mop head. The term "replaceable assembly" whenever used herein should, accordingly, not be taken to mean only a layer of material which is cut into continuous strips but should be understood to include the case in which a layer of material is shaped in any way suitable for providing the working portion of the head, of a mop (including, for example, a pattern of slits as described in U.S. Pat. No. 4,288,884).

Figure 7:
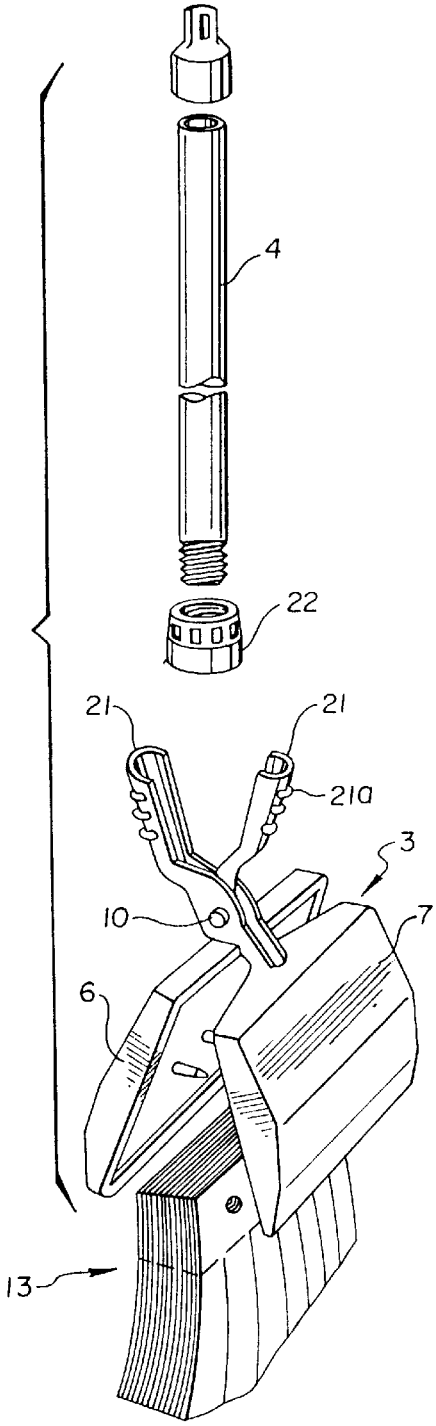
FIGS. 7 to 16 illustrate alternative forms of strip mop.

Yet another form of strip mop is shown, disassembled, in FIG. 7. The holder 3 for the replaceable assembly/assemblies 13 again comprises two halves 6, 7 which are pivotally connected together but, in this case, the holder must be separated from the mop handle 4 before it can be opened, Each half of the holder 3 has an upward extension 21 in which the pivotal connection 10 is located and which terminates in the shape of a half cylinder with a screw thread 21 a in its outer surface. When the holder 3 is closed, the extensions 21 meet to form a cylindrical portion which has the screw threads 21*a* in its outer surface and which has an internal diameter such that it will fit around the end of the mop handle 4. The mop also includes an internally-threaded clamping ring 22 which can be screwed onto the threads 21*a* when the extensions 21 are closed together as just described. When a replacement assembly 13 has been located in the holder 3 and positioned on the pins 12*a*, the clamping ring 22 is slipped onto the handle 4 and the holder is then closed with the end of the handle 4 located between the semi-cylindrical extensions 21. The clamping ring 22 is then slid down over the ends of the extensions 21 and is screwed onto the thread 21*a*, thereby holding the extensions 21 tightly together around the end of the handle 4 and at the same time clamping the replaceable assembly 13 within the holder 3. To remove the assembly 13 from the holder 3, it is necessary only to unscrew the clamping ring 22 from the extrusions 21 and slide it up onto the handle 4, whereupon the holder 3 can be opened. The end of the handle 4 is shown in FIG. 7 as being threaded although that is not necessary in this particular embodiment to enable the handle to be secured in the holder 3.

In a modified form of the mop shown in FIG. 7, threads 21*a* on the extensions 21 are omitted and the internally-threaded clamping ring 22 is replaced by a clamping sleeve which can be pushed over the extensions 21 when they are closed together around the end of the handle 4.

It will be noted that, in the mop shown in FIG. 7, the replaceable assembly 13 is not formed from folded layers of material but from layers which individually, comprise one half of a layer of FIG. 4 (i.e. terminating at the halfway line 17). To facilitate the location of the replaceable assembly 13 in the holder 3, the lower edge of each half 6, 7 of the holder can be cut-away to accommodate the assembly.

Figure 8:
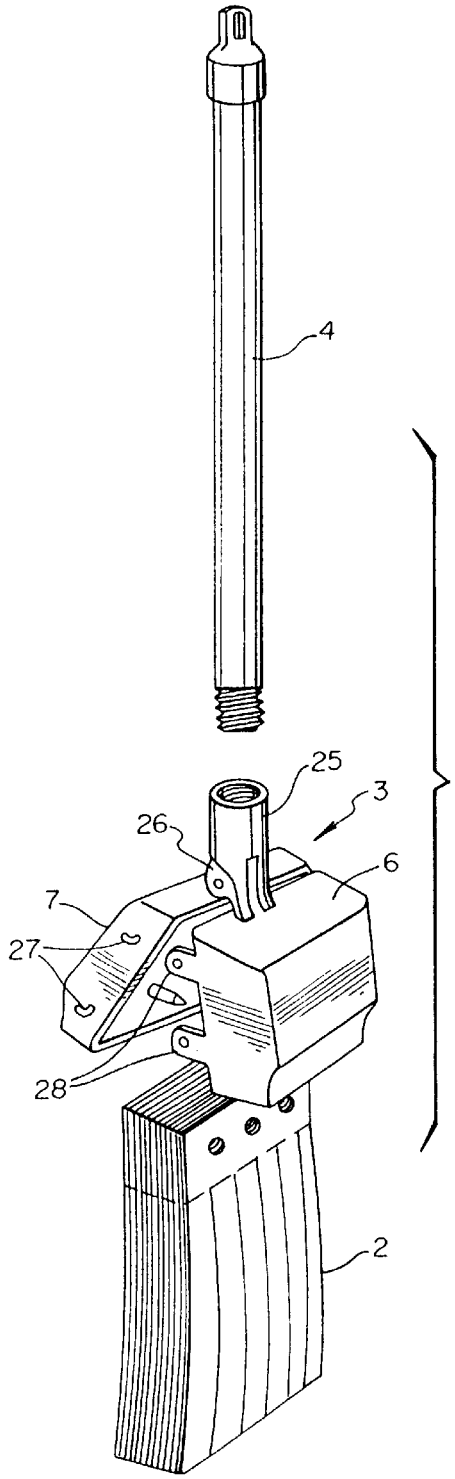

A further form of strip mop is shown, disassembled, in FIG. 8. In this case, the half 6 of the holder 3 is formed with a cylindrical extension 25 into which the end of the mop handle 4 is screwed. The other half 7 of the holder 3 is pivotally-connected at 26 to the base of the cylindrical extension 25 and is provided, on each side, with hooks 27 which can engage in tabs 28 on the half 6 of the holder, to retain the holder 3 in the closed condition. The tabs 28 are formed from the same plastics material as the rest of the holder 3 and are flexible enough to allow a user to disengage them from the hooks 27 to open the holder 3 (as shown in FIG. 8) when the strips 2 are to be replaced.

It will be noted that the holder 3 of the mop shown in FIG. 8 is less flat than those shown in FIGS. 1 and 5 and, accordingly, provides a larger amount of space internally to accommodate the strips 2. If necessary, the lower edge of each half 6, 7 of the holder could also be cut away as already described for the mop of FIG. 7.

In the mop shown in FIG. 8, the handle 4 is intended to be screwed into the holder 3 and is, therefore, threaded. It could, however, simply be a push fit in the cylindrical extension 25.

Figure 9:
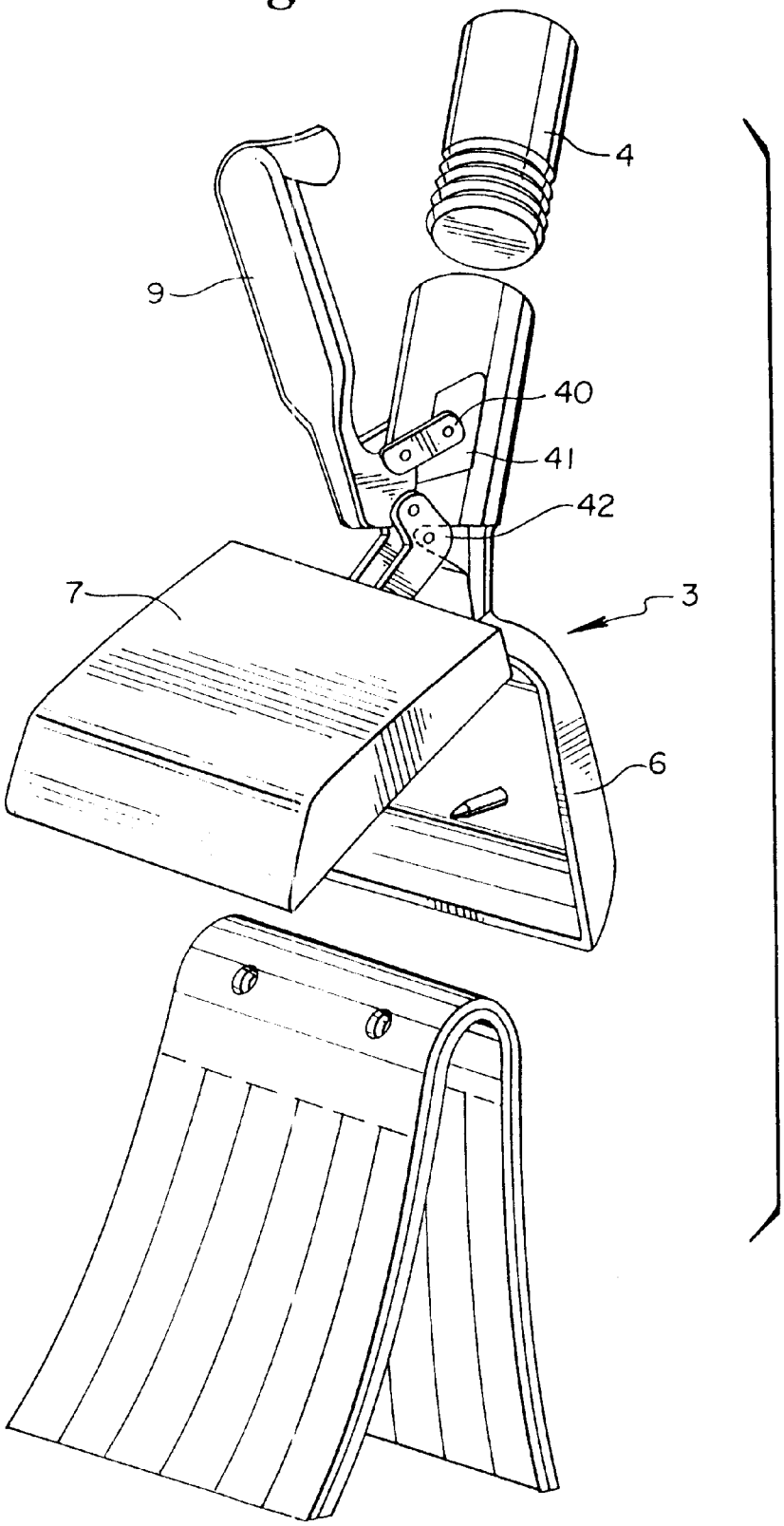

The mop shown, disassembled, in FIG. 9 is generally similar to that shown in FIGS. 1 to 3 except that the lever portion 9 is not a direct extension of the part 7 of the holder 3 but is connected to the part 7 through a series of pivotally-connected links 40, 41, 42. By a suitable choice of the shape of the links and the positioning of the pivotal connections, it can be ensured that the lever 9 will not inadvertently be forced out of engagement with the mop handle as a result of pressure on the holder 3 when the mop is in use.

It will be appreciated that, in each of the mops illustrated by FIGS. 1 and 7 to 9, the particular shaping of the holder 3 is not an essential feature. For example, the holder 3 of FIG. 8 could have a similar shape to those of FIGS. 1 and 5 (or vice versa). In addition, the recesses 12*b* on the inside of the half 7 of the holder 3 could be omitted, or replaced with further pins similar to the pins 12*a* on the other half of the holder.

Figure 10:
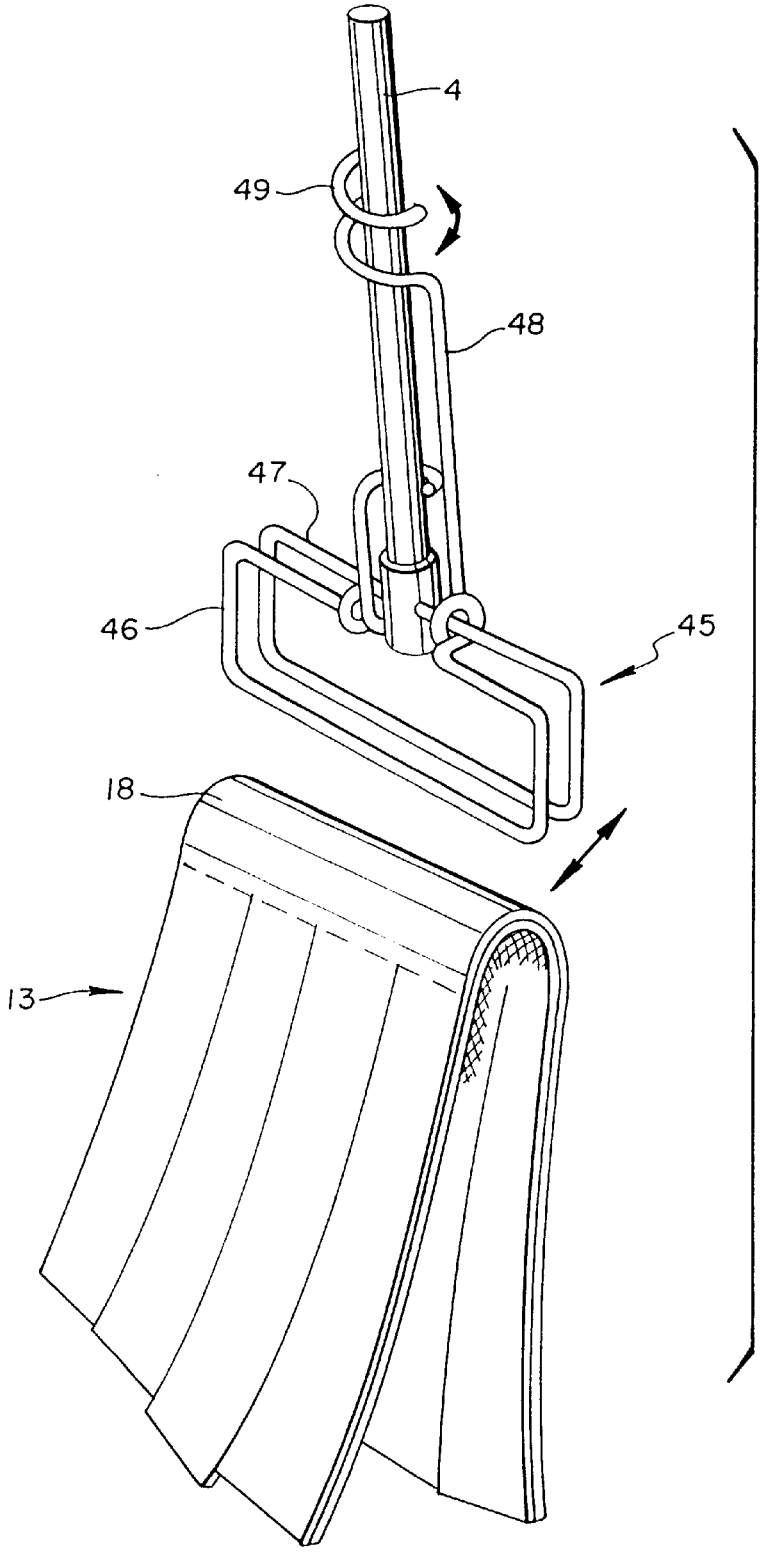

FIG. 10 illustrates a mop in which the holder for the replaceable assembly 13 is in the form of a frame 45 which is bent to define two parts 46, 47 which are hinged together and between which the strip assembly can be held. The frame 45 also extends to define a lever portion 48 which is used to open and close the holder 3 and which also has a portion 49 which can engage the mop handle 4 to secure the holder in the closed position. The frame 45 is of a type which is known for use in mops used for industrial cleaning purposes, in which case the frame is typically formed from bare metal and is of a size suitable for holding a mop head formed from heavy-weight cotton strings. In the present case, the frame 45 may be smaller, and may be formed from plastic-covered metal. The replaceable assembly 13, which is shown removed from the mop, is a simplified version of that shown in FIG. 1 in that no holes are required in the uncut portions 18 of the layers of material.

Figure 11:
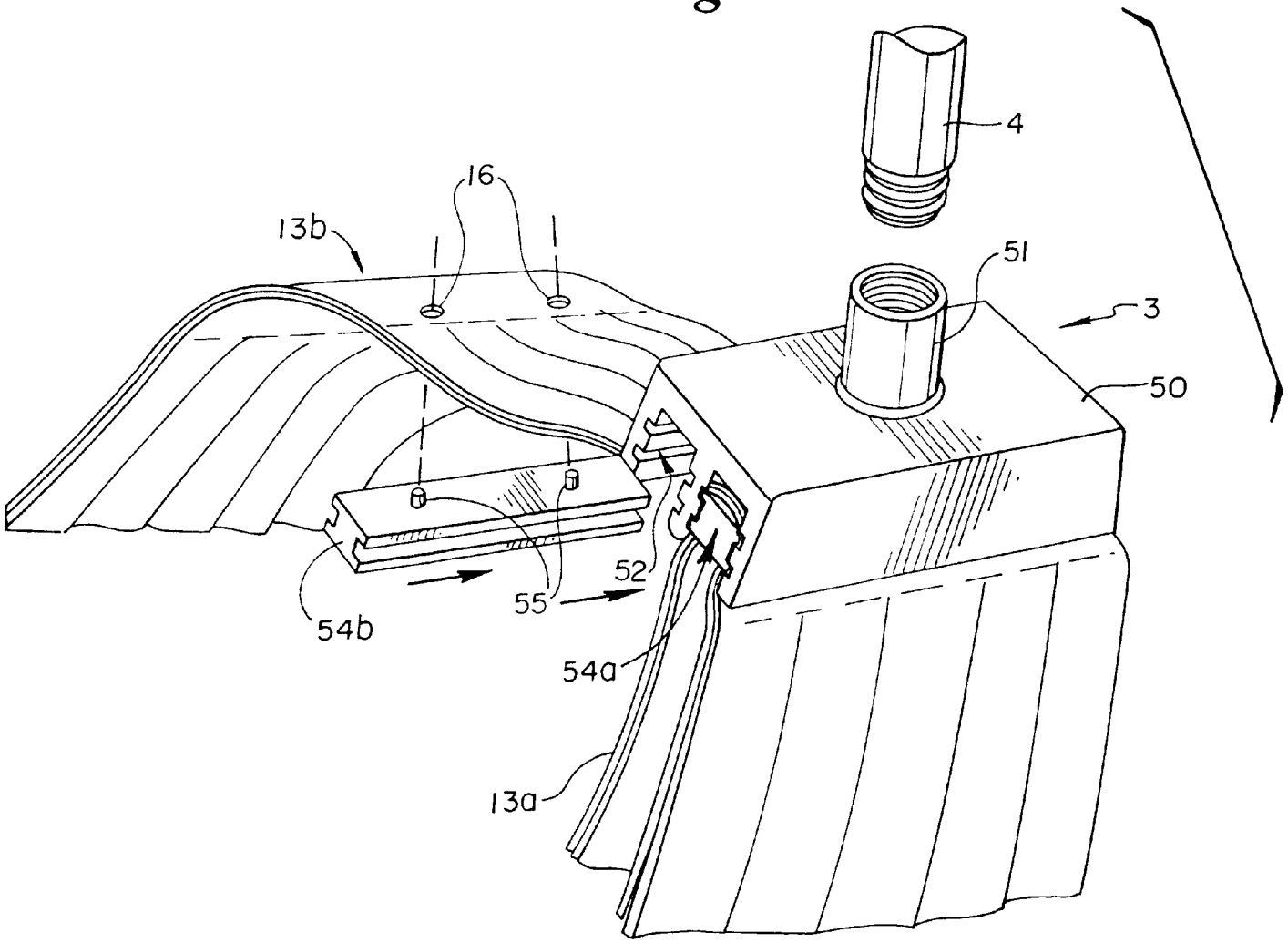

FIG. 11 shows, disassembled, another form of mop in which the holder 3 (which carries two replaceable assemblies 13) comprises a generally rectangular body 50 with an internally-threaded cylindrical extension 51 into which the mop handle 4 is screwed for use. Two support tracks 52 are formed integrally within the body 50.

Figure 13:
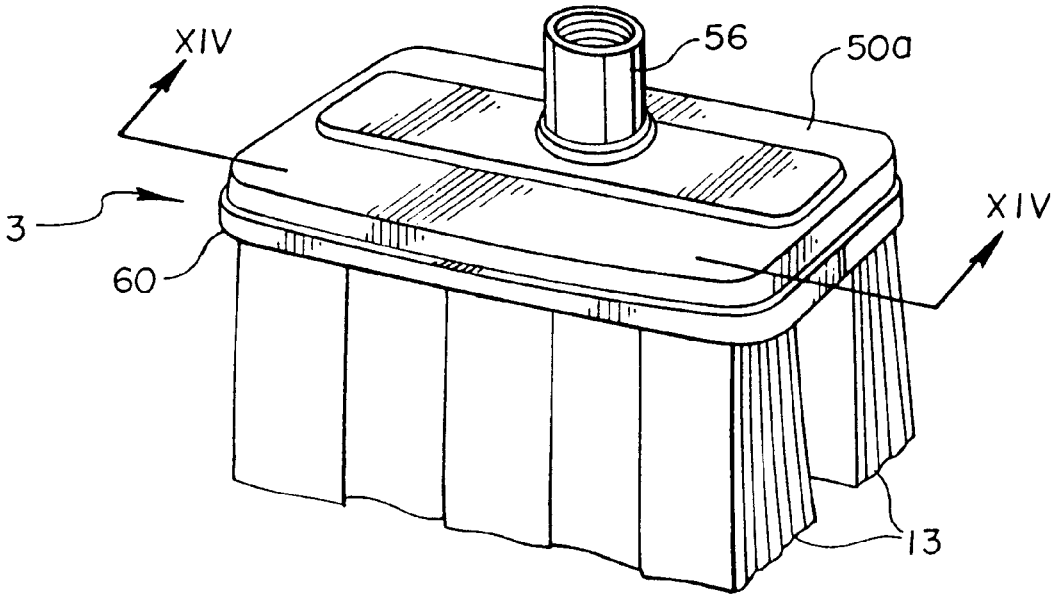

Each replaceable assembly 13 of the mop of FIG. 11 is of the general form shown in FIG. 4 but has only two location holes 16 in the central uncut region 15. Each assembly 13 hangs over a respective rail 54 and is positioned by two pins 55 which are provided on the rail to engage in the holes 16. The rail 54 in turn is shaped to engage in a respective one of the support tracks 52 by being slid in and out of the body 50 from one end of the latter. FIG. 13 shows one rail 54*a*, with the respective replaceable assembly 13*a*, in position within the body 50 and a second rail 54*b* removed from the body and the respective replaceable assembly 13*b* in the course of being replaced. When the strips 2 of either assembly 13 become worn, the assembly 13 can be replaced by sliding the respective rail 54 (with the assembly 13) out of the body 50. The replaceable assembly is taken off the rail 54 and replaced by another, following which the rail is put back in the support track. Although FIG. 11 shows the body 50 as housing two support rails 54 side-by-side (each of which supports a respective replaceable assembly) that is not essential and the body 50 may contain more than two such rails, or a single rail 54 only.

Figure 12:
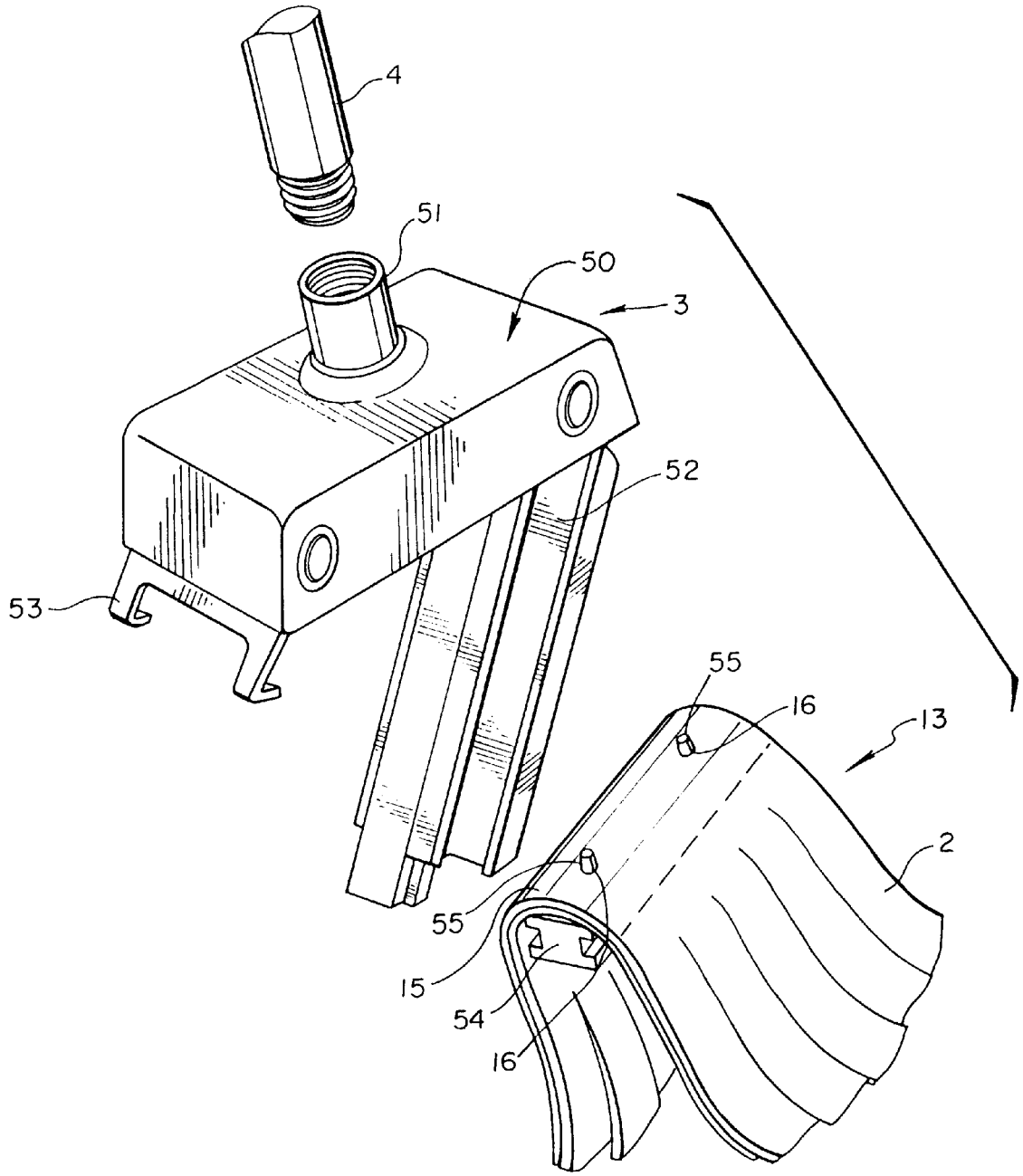

FIG. 12 shows, disassembled, a mop which is similar to that shown in FIG. 11 except that the support tracks 52 are pivotally mounted at one end so that they can be moved from a raised position (in which they are contained completely within the body 50) to a lowered position as shown. A hook-shaped catch 53 is provided on the body 50 to hold the free end of the support track 52 when it is in the raised position. To replace the assembly 13, the catch 53 is released and the support tracks 52 are lowered to the position shown in the drawing, whereupon the respective rail 54 (with the replaceable assembly) can be removed. The assembly 13 is taken off the rail and replaced by another, and the rail is then put back in the support track 52. As in the case of the mop of FIG. 11, the number of the rails 54 can be changed.

Figure 14:
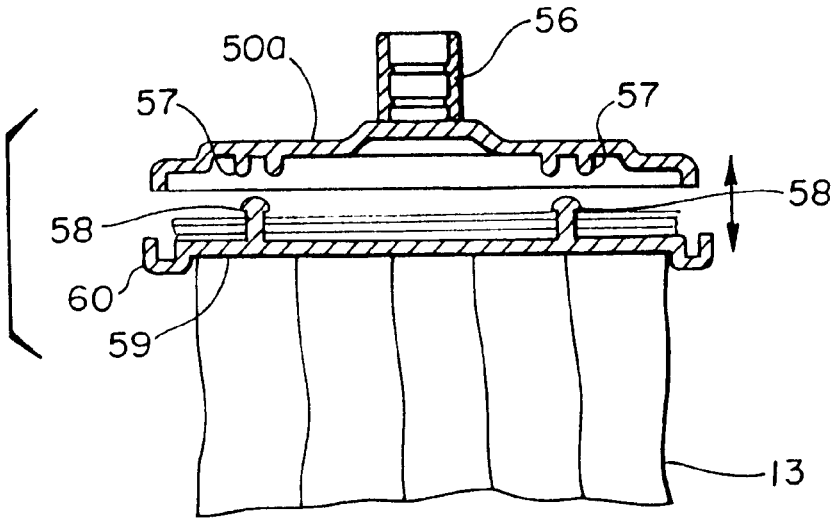

FIGS. 13 and 14 show a further form of mop head (FIG. 13 being a perspective view of the mop head removed from the handle 4 and FIG. 14 being a cross-sectional view on the line XIV—XIV in FIG. 13). In this case, the holder 3 includes a generally-rectangular cover 50*a* with a cylindrical, internally-threaded, extension 56 in which the mop handle (not shown) is screwed. The underside of the cover 50*a* is formed with sockets 57 into which pins 58 on a support rail 59 are a snap fit. The support rail 59 carries a respective replaceable assembly 13 similar to those shown in FIG. 12, with the pins 58 being positioned in the location holes 16 so that each strip assembly hangs down on either side of the rail. The rail 59 has a lip 60 into which the edge of the cover 50*a* will clip and which imparts a finished appearance to the holder 3. When the mop strips 2 become worn, the rail 59 is pulled away from the cover 50*a* as illustrated in FIG. 14 so that the strip assembly 13 can be replaced. The rail is then snapped back into position in the cover and the mop is again ready for use. As a modification, the support rail 59 could be configured to carry more than one set of strips in a side-by-side arrangement.

Figure 15:
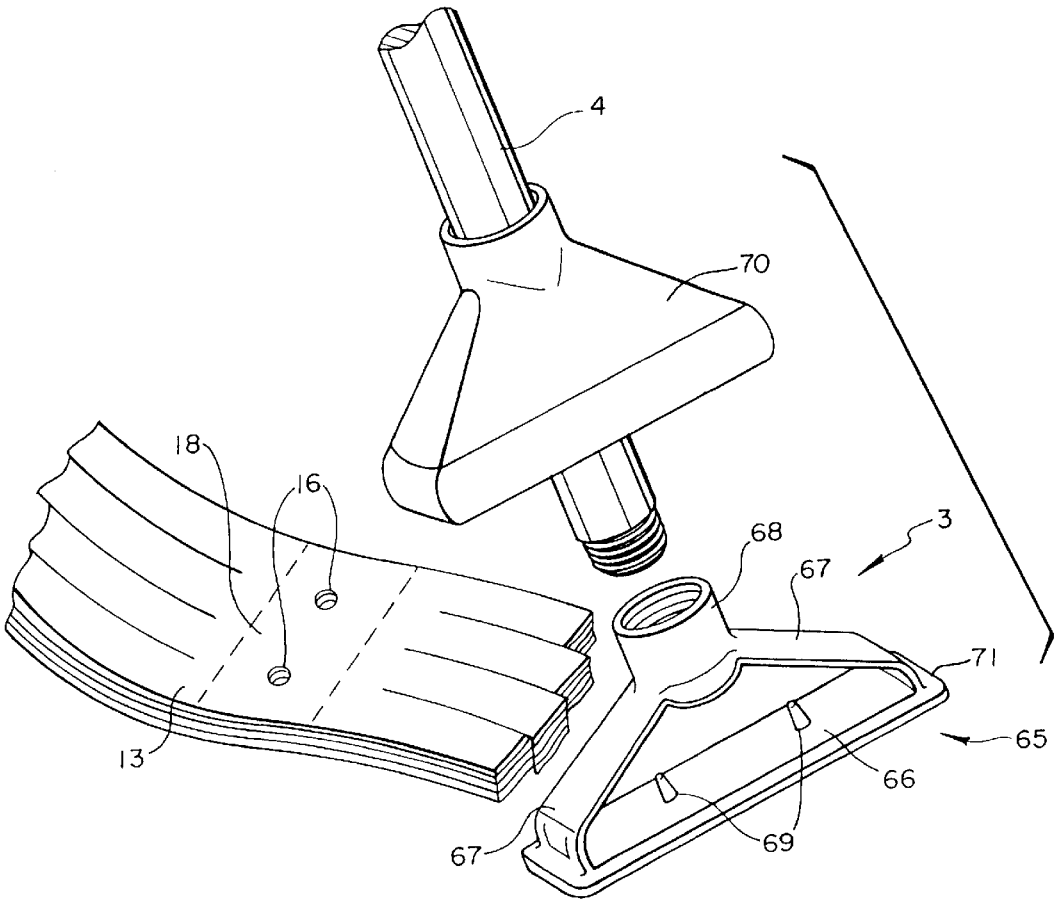

FIG. 15 is an exploded view of a mop head in which the holder 3 for the replaceable assembly 13 comprises an open triangular carrier 65 having a base 66, over which the replaceable assembly can be hung, and two sides 67 which connect the ends of the base to a cylindrical, internally-threaded extension piece 68 into which the end of the mop handle 4 can be screwed. The strip assembly 13 is similar to that shown in FIG. 12, and the base 66 of the carrier 65 is formed with two pins 69 which can engage in the two location holes 16 in the uncut portion 15 of the replaceable assembly to hold the latter in position. The holder 3 also comprises a cover 70 for the carrier 65, the cover having a central aperture through which the mop handle 4 passes. When the mop handle 4 is screwed into the carrier 65, the cover 70 can be slid up and down on the handle between a raised position in which the carrier 65 is exposed (as shown in the drawing) and a lowered position in which the cover clips onto a rim 71 around the edge of the carrier and covers the carrier. If a strip assembly 13 is positioned in the carrier 65, then the assembly will be clamped in place by the cover 70. To replace the strip assembly 13, it is necessary only to raise the cover 70, remove the strip assembly from the carrier and replace it by another, and then lower the cover 70 again. In this case also, the carrier could be configured to carry more than one set of strips.

Figure 16:
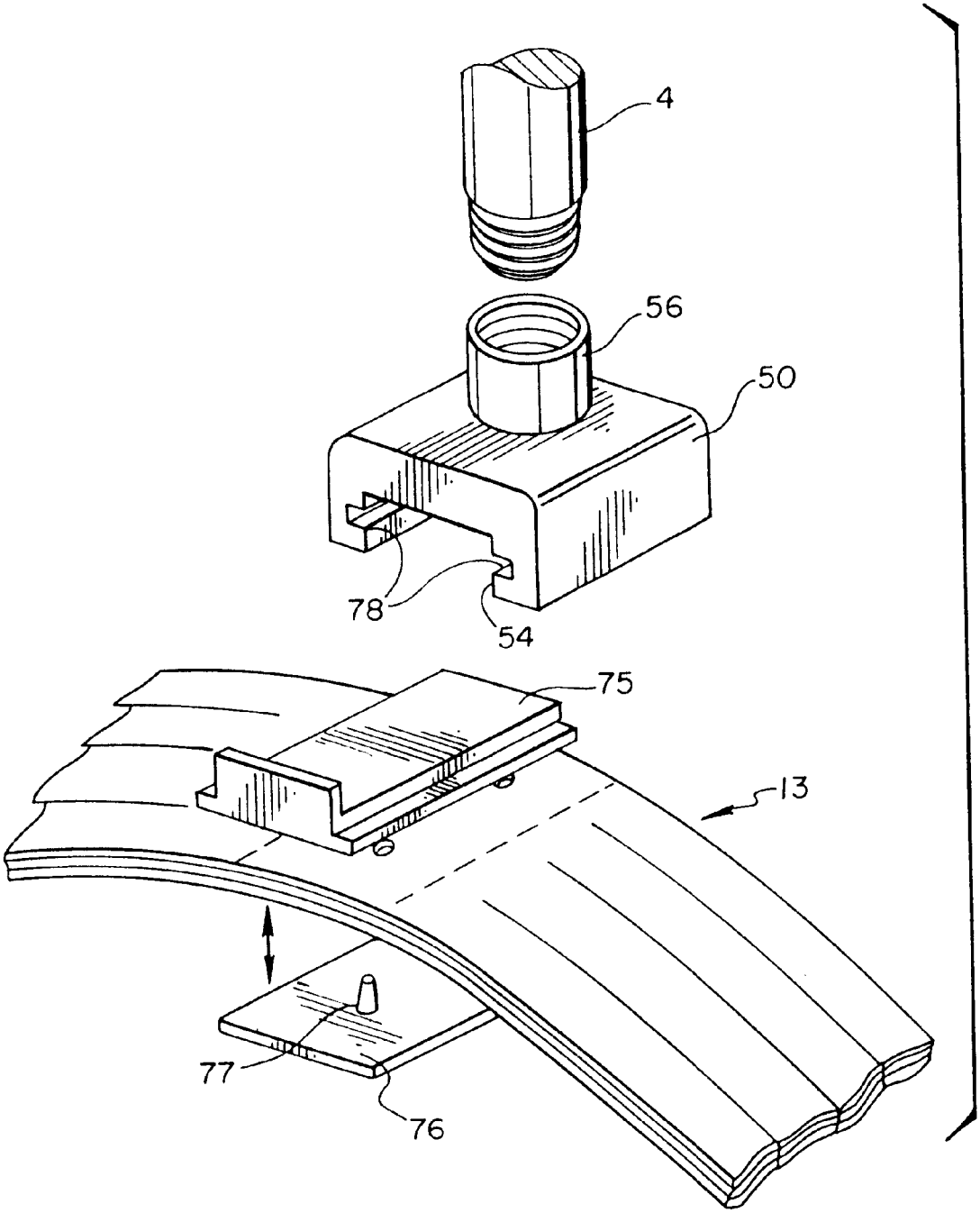

FIG. 16 is an exploded view of a mop head which is generally similar to that shown in FIG. 11 except that there is only one support track 54 formed in the body 50. In addition, in this case, the rail from which the replaceable assembly 13 is hung is formed in two parts 75, 76 and the strip assembly is held between them. The lower part (76) of the rail is formed with two pins 77 which can engage in the location holes 16 in the uncut portion 18 of the strip assembly, and which then engage in corresponding holes (not visible) in the upper part (75) of the rail. The complete rail 75, 76, with the strip assembly 13, is then slid into the track 54 in the body 50, with the edges of the parts 75, 76 being located in slots 78 in the sides of the track, and thereby held together. To replace the strip assembly, the rail 75, 76 is removed from the body 50 of the holder 3 and taken apart so that the strip assembly can be removed and replaced by another.

The replaceable assemblies 13 described above offer the advantage that, because they are generally rectangular, they are comparatively easy to handle and to package. They are also comparatively easy, and cheap, to manufacture. A mop using one of those replaceable assemblies, as shown in the drawings, requires only that the assembly should be replaced when the mop head becomes worn through use. The holder 3 of the mop head, in which the replaceable assembly is located is a permanent part of the mop, with the desirable consequence that there is less wastage of materials. Moreover, because the replaceable assembly can be separated from the holder it is possible for the assembly to be washed, if it should become soiled, and then put back in the mop.

Each of the replaceable assemblies 13 shown in the drawings comprises a plurality of separate layers of material. A replaceable assembly could, however, be formed from a single layer of material similar to that shown in FIG. 5 but of greater length in the direction of the stitching line 14 so that it can be rolled up loosely, in the direction of the stitching line and then flattened to a shape comparable to that of the assembly 13 of FIG. 7.

Moreover, although each layer of the replaceable assemblies shown in the drawings comprises a plurality of comparatively narrow strips 2, the width and number of the strips is a matter of choice. In an extreme case, each layer could comprise a single strip having the same width as the assembly. The individual strips 2 do not need to have straight edges as shown but could, for example, be formed with wavy or zigzag edges. It is also not essential for the layers to be generally rectangular in shape; they could, for example, be trapezoidal with the narrower end being intended to be held in the mop holder 3.

A replaceable assembly 13 of the type shown in FIG. 7 can be manufactured by laying together (one on top of another) full width web material from several rolls; stitching across the full width of the layers; and then feeding the layers to a cutting press which will, simultaneously:

(i) cut across the width of the layers at a distance from the stitching (ii) cut the location holes 16

(iii) make a plurality of cuts parallel to the length of the layers of material to form the strips 2, and (iv) make a plurality of cuts parallel to the length of the layers of material to separate adjacent assemblies.

The number of layers of material that can be stitched or cut at any one time may be limited and several such assemblies 13 may be required to fill the holder 3 of a mop. A suitable number of assemblies may, therefore, be packaged and sold together. The packaging may be of any suitable type, extending from packaging which completely encloses the replaceable assemblies to packaging in the form of a band which simply holds the assemblies together. Instructions are preferably provided with the replaceable assemblies regarding insertion of the assemblies in an appropriate holder in a mop (which need not be any of the mops illustrated in the accompanying drawings). Alternatively, or in addition, the assemblies themselves may carry the instructions in the form of printed matter on the assemblies.

Figure 17:
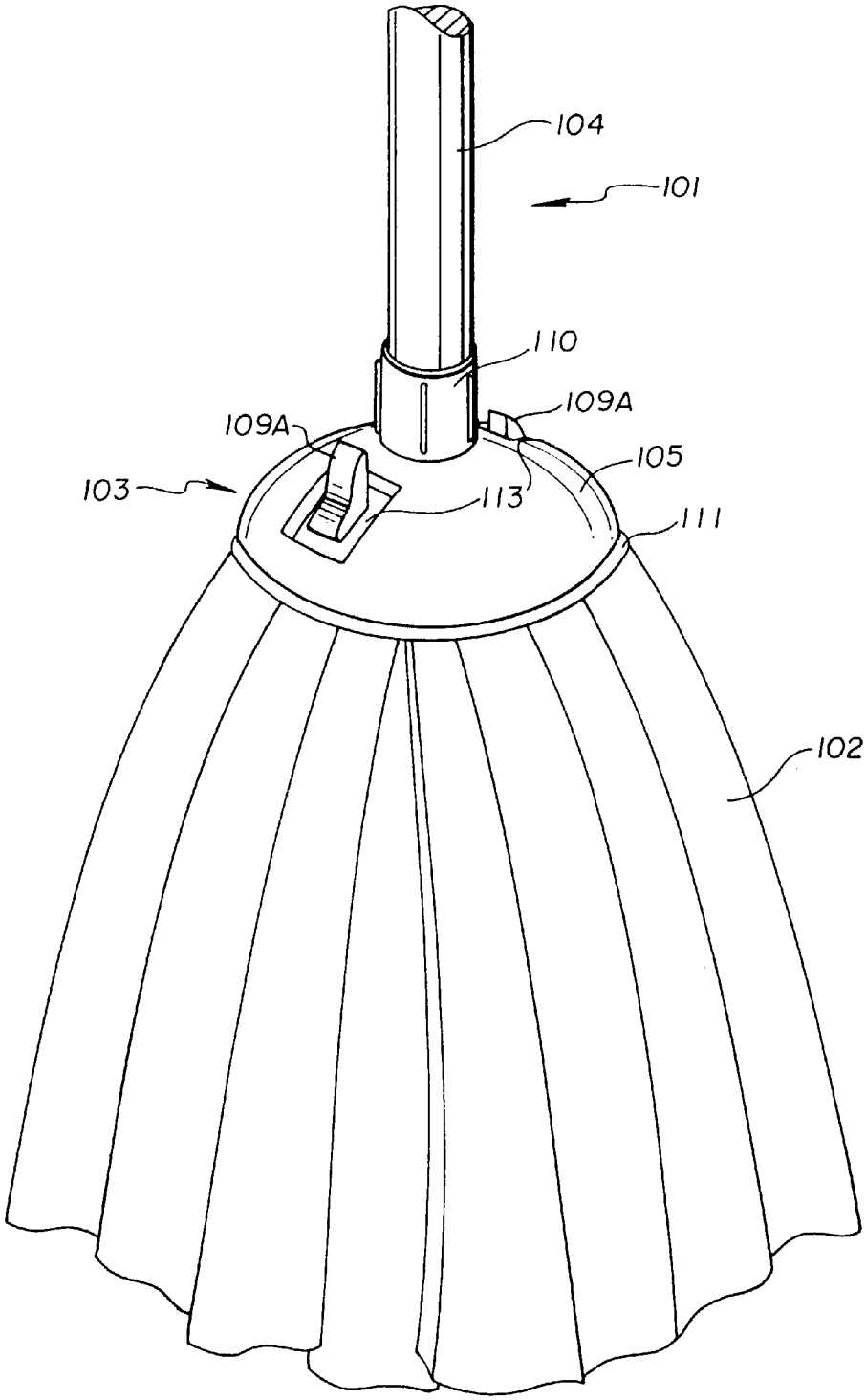
FIG. 17 is a perspective view of another strip mop.

The mop shown in FIG. 17 is a floor mop and has a head 101 comprising a plurality of fabric strips 102 (not shown full length) secured in a holder 103 at one end of a stick-like handle 104 (only part of which is shown). The strips 102 are formed from a conventional non-woven absorbent material, for example a thermo-bonded non-woven material or a coated non-woven material, and extend from the holder 103 for about 20 cm. The use of a non-woven absorbent material is not essential, however, and the strips could be formed from any other suitable material, for example (in the case of a floor mop), an absorbent extruded web material or a cellulosic sponge material. The strips 102 are a replaceable part of the mop, as will be described in greater detail below. The holder 103, on the other hand, is a permanent part of the mop, as is the handle 104. The holder 103, which will also be described in greater detail below, is formed from a plastics material (for example polypropylene filled with glass fibre), while the handle 104 is a conventional mop handle, about 120 cm long and formed, for example, from wood or a metal (which may be covered with a plastics material).

Figure 18:
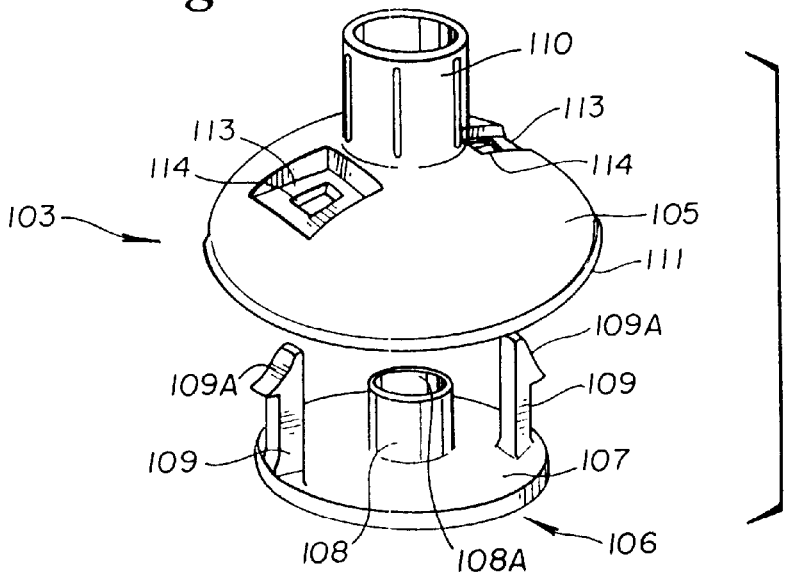
FIG. 18 is a perspective view of two components of the mop of FIG. 17, in a disassembled condition.

The holder 103, shown disassembled in FIG. 18, comprises a body portion 105 and a carrier 106 over which the strips 102 are hung when the mop head is being assembled. The carrier 106 has a flat, oval, base 107 (the largest and smallest diameters of which are about 4.5 cm and 3.6 cm respectively) on which are an upstanding socket 108 and two upstanding clips 109 which have hooked-shaped ends 109A (visible in FIG. 17). The clips 109, including the hook-shaped ends 109A, have a height of about 3.3 cm and the height of the socket 108 is about 2.5 cm. The socket 108, which is circular, is located centrally on the base 107 and the clips 109 are located at the edge of the base, one on each side of the socket. The cross-section of the internal recess 108A of the socket is generally rectangular with rounded ends. The body portion 105 is generally dome-shaped with a cylindrical extension 110, in the form of a socket about 4.3 cm long, for attachment to the mop handle 104. The outer periphery of the dome-shaped part of the body portion 105 is of the same oval shape as the base 107 of the carrier 106 but of a larger size (the largest and smallest diameters being about 7.5 cm and 6.5 cm respectively). Two recesses 113 on the outside of the body portion 105 contain respective openings 114 (about 0.4 cm by about 0.7 cm) in locations corresponding, to those of the clips 109 on the base 107 while, within the body portion, a centrally-positioned pin 116 (not visible in FIG. 18) which is about 2.3 cm long, extends downwards in a location corresponding to that of the socket 108. The cross-section of the pin 1 16 corresponds in shape to the recess 108A in the socket 108.

The particular dimensions given above for the various parts of the holder 103 are those of a preferred form of the holder but are not essential. Both the shape and the dimensions of the holder can be changed if required.

The holder 103 is assembled (see FIG. 20) by locating the dome-shaped part of the body 105 over the carrier 106 so that the pin 116 is located in the socket 108 and the clips 109 are located in the openings 114 with the hooked-shaped ends 109A of the clips engaged in the recesses 113. The carrier 106 can subsequently be released from the body 105 by pushing the two hook-shaped ends 109A of the clips 109 inwards, towards the centre of the body 105, until they can be withdrawn through the apertures 114, thus allowing the carrier 106 to be removed.

The holder 103 is simple to clip together and release, and allows the strips 102 to be changed quickly and easily. Various modifications could, however, be made to the holder 103 of FIG. 17 while retaining the clip-together engagement between the carrier 106 and the body 105.

The extension 110 on the body portion 105 is threaded internally, at 118, and the end of the mop handle 104 is also threaded so that it can be screwed into the socket. Alternatively, the, handle 104 may simply be a push fit in the extension 110. As yet another alternative (described below), the socket may be shaped to enable a suitable handle to be a snap-fit on the extension 110.

Figure 19:
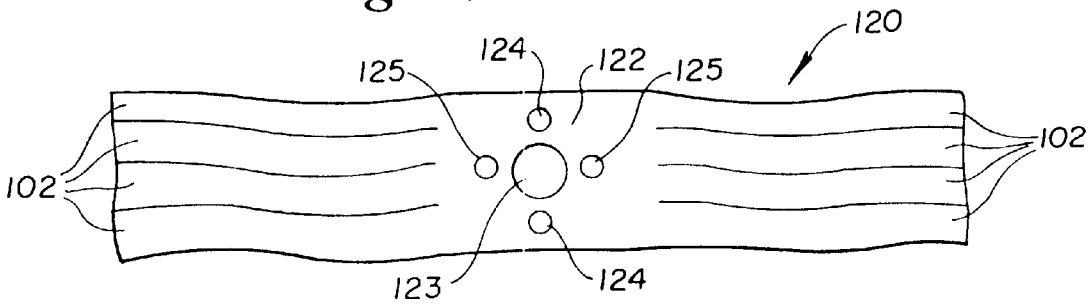
FIG. 19 is a plan view of one layer of a replaceable assembly for the mop of FIG. 17.

The mop strips 102 are provided by a plurality of layers 120 of material, which are arranged one on top of another on the carrier 106 before the latter is located in the body portion 105 as described above. Each of the layers 120 is of a generally rectangular shape, as shown in FIG. 19, and is cut into strips 102 from each end inwards leaving a central section 122 which is uncut. A central aperture 123 is cut in the central section 122, together with two pairs of smaller apertures 124, 125. The larger aperture corresponds generally in size to the socked 108 on the carrier 106 and each pair 124, 125 of the smaller apertures corresponds generally in size (and in location relative to the larger aperture 123) to the clips 109. A layer of material 120 as shown in FIG. 19 is located on the carrier 106 by locating the aperture 123 over the socket 108 and one of the pairs of apertures 124, 125 over the clips 109. It will be appreciated that, if the apertures 124 are used, the layer 120 will lie in one direction on the carrier 106 and, if the apertures 125 are used, it will lie in a direction at right angles. When the mop head is being assembled, a plurality of similar layers 120 is located on the carrier, some of the layers being positioned so that they lie in one direction on the carrier 106 and the rest being positioned to lie in the other direction. The carrier 106 is then located in the body portion 105, as already described, thereby trapping the central sections 122 of the layers 120 in the mop head 103 with the strips 102 of the layers hanging out through the space between the periphery of the carrier 106 and the larger periphery 111 of the dome-shaped portion of the body 105.

Typically, the layer of material shown in FIG. 19 is about 7 cm wide and the strips 120 at each end of the layer are about 20 cm long. The distance between the innermost ends of the strips 120 (i.e. across the central section 122) is similar to the width of the layer. The dimensions of the central section 122 are such that it will be substantially contained within the holder 103. The larger aperture 123 is about 1.3 cm in diameter and the smaller apertures 124, 125 are each about 0.6 cm in diameter.

Because the layers 120 hang from the holder 103 in two orthogonal directions, there are strips 102 around the whole periphery of the mop head, as in a conventional strip mop. In this case, however, it is possible to renew the strips 102 when they become worn: it is necessary only to release the carrier 106 from the body portion 105 as described above, and then to remove the layers 120 and replace them with new ones. Alternatively, if the strips 102 are not worn but only dirty, it is possible for the layers 120 to be washed and re-used.

Figure 21:
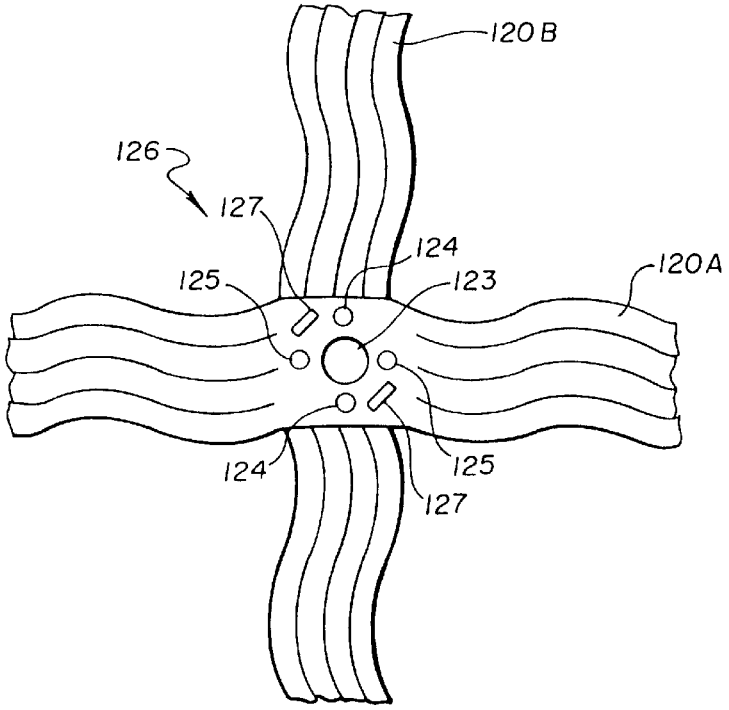
FIG. 21 is a plan view of a replaceable assembly for the mop of FIG. 17.

Replacement layers 120 for a mop as shown in FIG. 17 are preferably available already assembled, as shown in FIG. 21. The replaceable assembly 126 shown in FIG. 21 comprises several layers 120, each as shown in FIG. 19, some (120A) of which lie in one direction and the rest of which (120B) lie in the direction at right angles. The central apertures 123 of the strips are all aligned with each other, and the apertures 124 of the layers 120A are aligned with the apertures 125 of the layers 120B (and vice versa). The layers are held together by two plastic tags 127 which extend through the complete assembly 126.

To insert the assembly 126 into the mop of FIG. 17, it is necessary only to place the whole assembly on the carrier 106, with the socket 108 located in the aligned central apertures 123 and the clips 109 located in one of the pair of aligned apertures 124, 125. The plastic tags 127 need not be removed. The body portion 105 is then positioned on the carrier to secure the assembly 126 in place.

Typically, the assembly 126 comprises nine layers 120 arranged in three groups each of three adjacent layers which lie in the same direction. The assembly 126 thus comprises a top group of three layers 120A, a middle group of three layers 120B, and a bottom group also of three layers 120A. It will be appreciated, however, that the number of layers used to make up the assembly 126 (as well as the number used in each of the two directions) can be varied as required. Adjacent layers of the assembly could, for example, alternate in direction instead of being arranged in groups.

Figure 22:
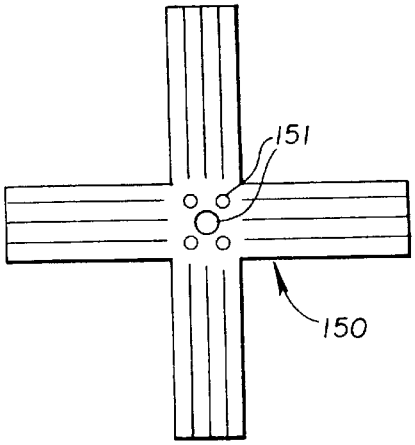
FIGS. 22 to 31 show alternative replacement assemblies for the mop of FIG. 17.

As a further alternative, the assembly of FIG. 21 could be formed from a plurality of layers 150 each having a cross-shaped form as shown in FIG. 22. Each arm of the cross is cut into strips from its extreme end, and apertures 151 which enable the layers 150 to be hung on the carrier 106 of the mop holder are provided in the centre of the cross. Replacement strips as shown in FIG. 22 can, however, not be cut from web material without a substantial amount of waste.

The replacement assembly 126 shown in FIG. 21 can, of course, be packaged in any suitable way (taking advantage, if required, of the fact that the assembly can be folded and does not, therefore, have to be packaged flat). It would, for example, be possible to fold down the layers of strips 102 (i.e. to form the assembly 126 into the general shape that it would have in a mop) before the assembly is packaged. The packaging may take any suitable form, extending from a complete enclosure to a simple band which surrounds the strips 102 and gathers them together. The assembly, whether packaged or not, may be supplied with instructions regarding insertion of the strip assembly in a mop holder. Alternatively, or in addition, the strip assembly 126 itself may carry the instructions in the form of printed aterial.

The tags 127 that are used to hold the layers of the assembly 126 together can be replaced by any other suitable securing means, provided that the alternative does not prevent the body portion 105 of the mop holder being located on the carrier 106 when the replacement assembly 126 is in position. The various layers of the assembly 126 could, for example, be held together by staples, or they could be stitched together.

It will be appreciated, however, that it is not essential for the replacement layers 120 for the mop of FIG. 17 to be provided in the form of a complete assembly as shown in FIG. 21. The replacement layers 120 could, for example, be available individually or in assembled groups of aligned layers which the user would then place on the carrier 106 in the desired orientation.

It will also be appreciated that the size and location of the apertures 123, 124 and 125 in the layers 120 are determined by the construction of the carrier 106 of the mop holder. If an alternative form of carrier 106 were used, the form of the layers 120 would be adjusted accordingly. When the carrier 106 has the form shown in FIG. 18, only one of the pairs of apertures 124, 125 is required in each of the layers and it would, therefore, be possible for the other pair of holes to be omitted. That has the disadvantage (from a manufacturing viewpoint) that the layers would not all be the same since, in some of the layers, the holes 124 would be required while, in others, it would be the holes 125.

The strips shown in the drawings have wavy edges but that is not essential: they could, for example, have straight or zigzag edges. It is also not essential for the central, uncut, part 122 of each layer 120 to have generally the same width as the rest of the layer: the central part could be wider, or narrower, than the rest of the layer, depending on the size and shape of the mop holder 103 in which it is to be used.

FIGS. 23 to 31 illustrate, by way of example, other replacement layers of material which could be used in the mop head holder of FIG. 18.

Figure 23:
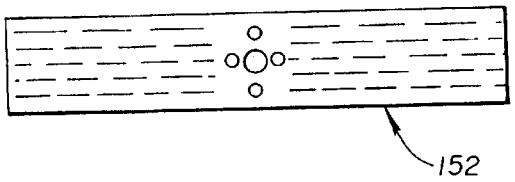

FIG. 23 shows a replacement layer 152 which is similar to that shown in FIG. 19 but has straight edges and is cut into skip slits (as described above) rather than continuous strips. The layer 153 of FIG. 24 is also similar to that of FIG. 19 but, in this case, each end portion of the layer constitutes a single strip (i.e. there are no longitudinal cuts subdividing the layer across its width).

Figure 24:
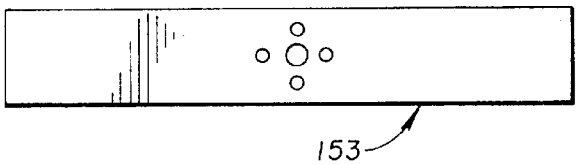
Figure 25:
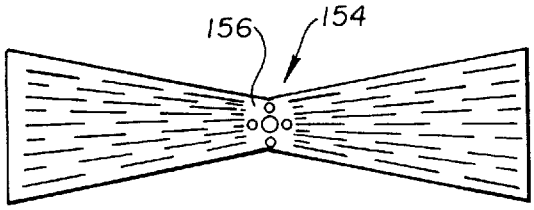
Figure 26:
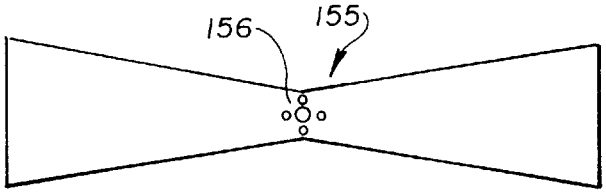
Figure 27:
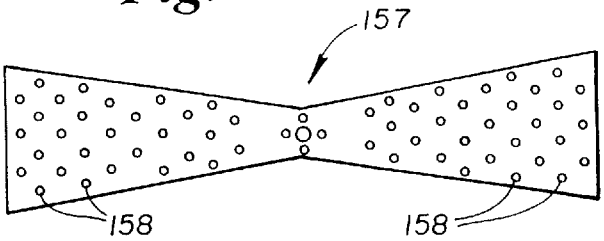

FIGS. 25 and 26 show replacement layers 154 and 155 which correspond, respectively, to the layers 152 and 153 of FIGS. 23 and 24 except that the width of each layer increases from the central portion 156 out towards each end. The replacement layer 157 of FIG. 27 is similar to the layer 155 of FIG. 26 except that an array of apertures 158 is formed in the end portions of the layer (i.e. in the parts of the layer that will form the working portion of the mop head).

Figure 28:
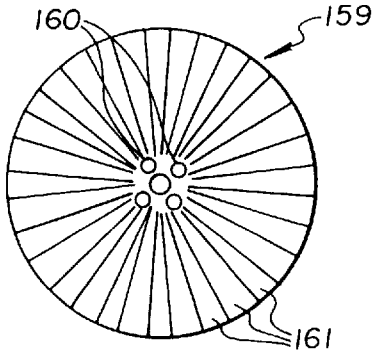
Figure 29:
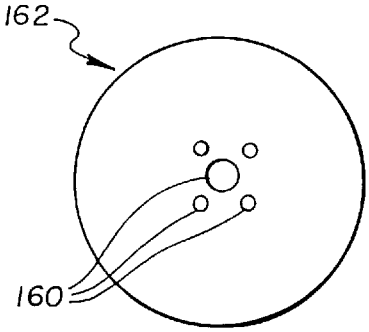
Figure 30:
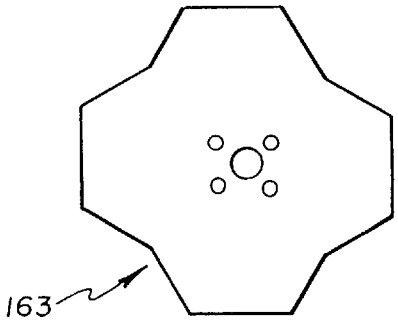
Figure 31:
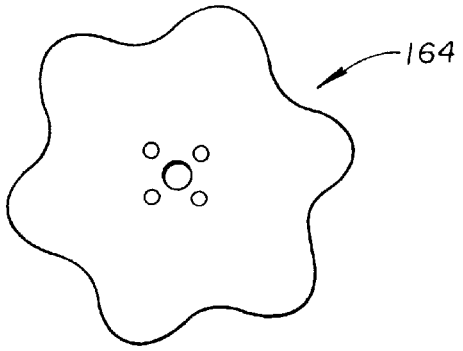
Figure 32:
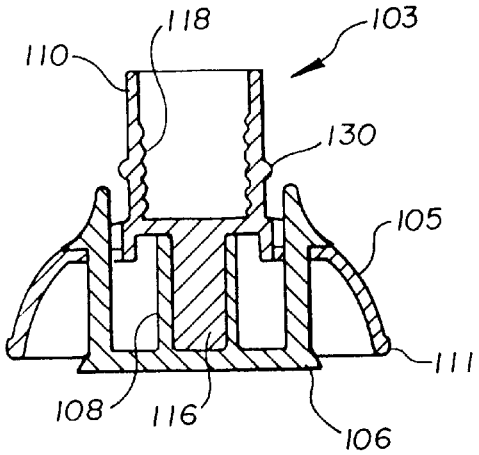
FIG. 32 is a cross-section (similar to FIG. 20 but without the replaceable strip assembly) of a mop head with an alternative fixing system for the handle.
Figure 33:
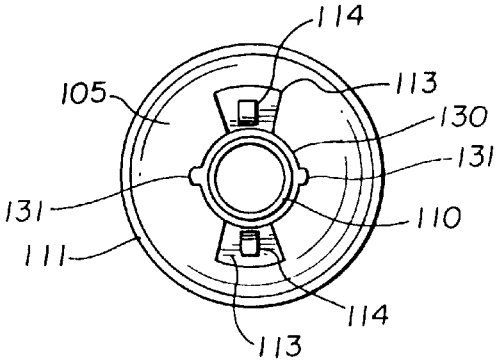
FIG. 33 is a view from above of the body portion of the mop head of FIG. 32.
Figure 34:
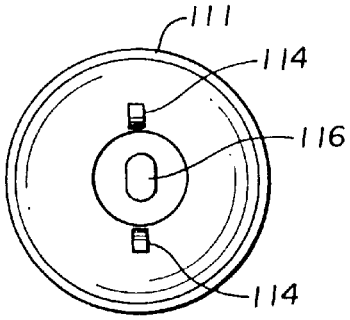
FIG. 34 is a view from below of the body portion of FIG. 33.
Figure 35:
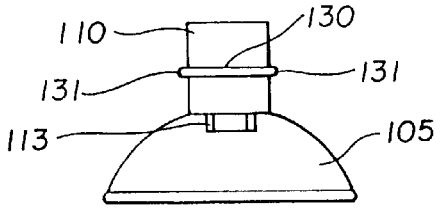
FIG. 35 is a side view of the body portion of the mop head of FIG. 32.

FIG. 28 shows a replacement layer 159 which is circular rather than rectangular. Apertures 160 which enable the layer 159 to be hung on the carrier 106 of the mop holder (FIG. 18) are provided in the centre of the circular layer, and the remainder of the layer is cut into a plurality of radial strips 161. The replacement layer 162 shown in FIG. 29 is also circular but, unlike the layer 159 of FIG. 28, is not cut into radial strips. The replacement layers 163 and 164 of FIGS. 30 and 31 are generally similar to the layer 162 of FIG. 29 but, in each case, have a shaped periphery.

Figure 20:
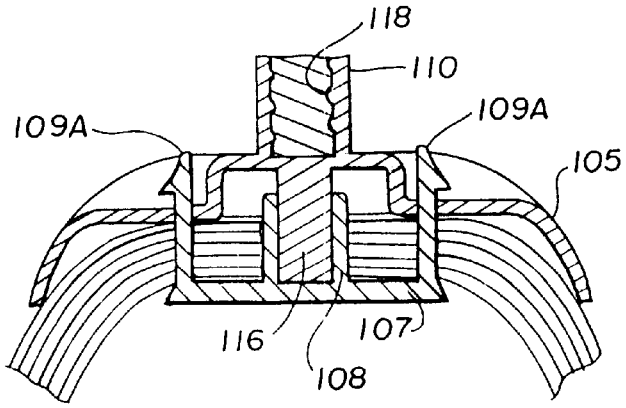
FIG. 20 is a cross-section of the head of the mop, in an assembled condition.

The mop head holder 103 illustrated in FIGS. 32 to 35 is the same as that shown in FIGS. 17, 18 and 20, except that the cylindrical extension 110 on the body portion 105 is provided with an external circumferential rib 130 which enables the mop holder to be attached to a handle (not shown) which has an external socket at one end. In that case, the extension 110 functions as a spigot and is pushed into the socket on the handle until the rib 130 clips into a corresponding groove on the inside surface of the socket (or, alternatively, over a suitably-positioned lip on the socket). Preferably, the socket on the handle has a degree of resilience to enable it to receive the cylindrical extension 110: that resilience can, for example, be obtained by providing one or more longitudinally-extending slots in the socket, or by forming the socket from a resilient material. Typically, the rib 130 projects radially outwards from the surface of the extension 110 for about 1.0 mm and has a depth (i.e. axially of the extension 100) of about 2.0 mm.

Preferably, in such an arrangement, the connection between the mop head holder 103 and the mop handle prevents the holder from rotating on the handle: in FIGS. 32 to 35, for example, the circumferential rib 130 is provided with two diametrically-opposed projections 131 (FIGS. 33 and 35) which engage in suitable locations in the socket on the handle and prevent relative movement between the mop holder and the handle, particularly when the mop is in use. When the socket on the handle is formed with longitudinally-extending slots as described above, to enable it to be pushed over the extension 110, the projections 131 may engage in those slots. Typically, the depth of the projections 131 is the same as that of the rib but they project radially outwards from the surface of the extension 110 for about 5.0 mm. The width of the projections 131 in the circumferential direction, is about 3.0 mm.

The cylindrical extension 110 of FIGS. 32 to 35, like that of FIG. 17, is also an internally-threaded at 118 so that it can be used with a handle having a threaded end (and also a push-in handle), as well as a handle which is provided with a socket for engagement with the rib 130.

Figure 51:
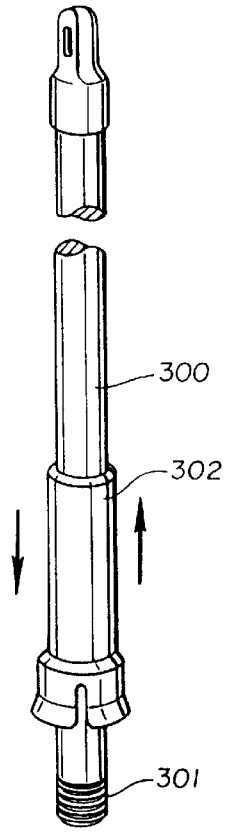
FIG. 51 illustrates an alternative form of handle for use with the mop head shown in FIGS. 32 to 35.
Figure 52:
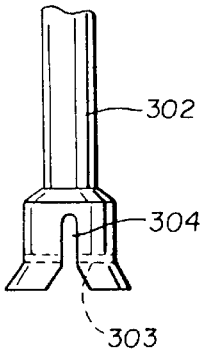
FIG. 52 illustrates a component of the handle of FIG. 51.
Figure 53:
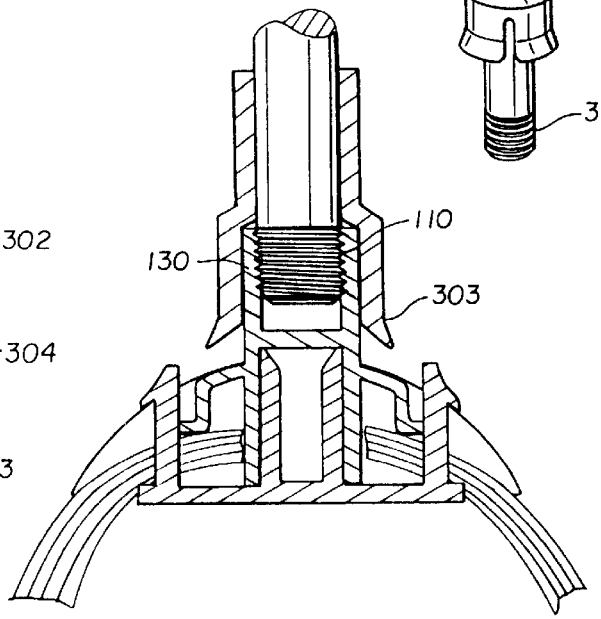
FIG. 53 is a diagrammatic cross-section showing the handle of FIG. 51 attached to a mop head similar to that of FIG. 42.

One form of handle 300 that can be used with the holder 103 is illustrated in FIGS. 51 to 53. The handle 300 has a threaded end 301 which can be secured into the extension 110 to engage with the internal thread 118. To impart additional strength, and a more finished appearance, to the coupling between the handle 300 and the holder 103, the handle is provided with a sleeve 302 (shown separately in FIG. 52) which can slide along the handle and which is shaped, at its lower end, to fit around the outside of the extension 10 and clip onto the rib 130 as indicated, diagrammatically, in FIG. 53. In particular, the lower end of the sleeve 302 is of larger diameter, to fit around the outside of the extension 110, and has an internal groove 303 in which the rib 130 will engage, together with two diametrically-opposite longitudinal slots 304 in which the projections 131 will be located.

As an alternative, the end 301 of the handle 300 need not be threaded but could simply be a push-in fit in the extension 10. In that case, because it is not necessary to rotate the handle 300 and the holder 103 relative to one another to joint them together, the sleeve 302 can be integral with the handle so that pushing the handle into the extension 110 results in the sleeve clipping onto the rib 130.

It will be appreciated that the external shaping of the extension 110 (in particular the rib 130 and projections 131) can be varied provided that corresponding changes are made to the clip-on socket on the mop handle or, in the case of the handle of FIG. 51, to the sleeve 302. For example, the number and shape of the projections 131 can be varied. In addition, it is not essential for the rib 130 to extend continuously around the extension 110; the rib could, for example, be broken in one or more places.

The mop head holder 103 shown in FIG. 17 has an oval shape, which is advantageous because it enables the mop head to reach more easily into corners and other constricted spaces. The oval shape is not essential, however, and the holder 103 could, for example, be circular.

Figure 36:
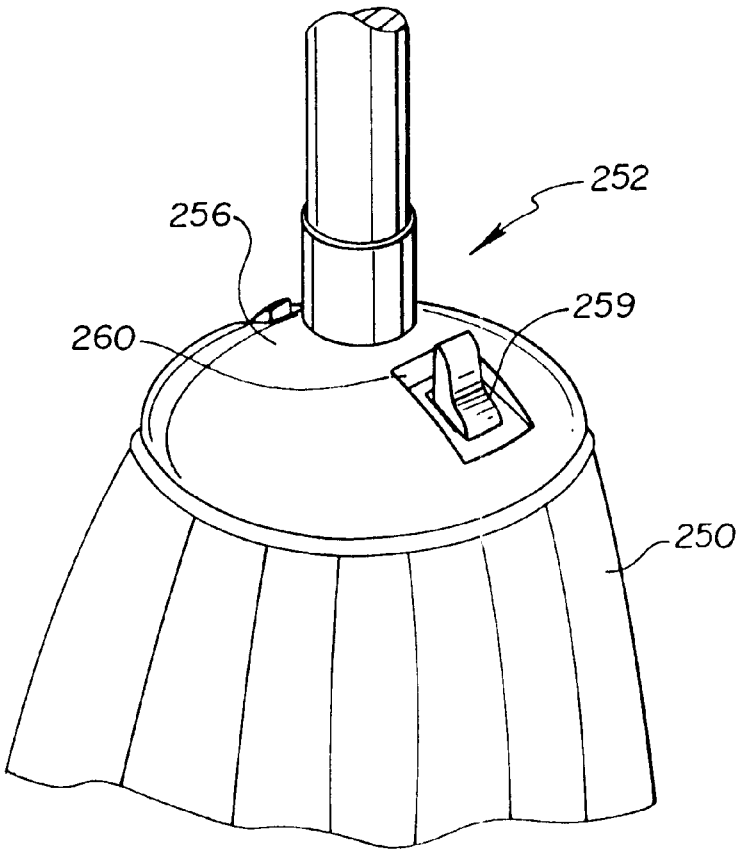
FIG. 36 is a perspective view of a modified version of the mop shown in FIG. 17.

The mop shown in FIG. 36 is generally similar, in external appearance, to that shown in FIG. 17. It differs, as can be seen from FIG. 37, in the form of the replacement strip assembly 250 and in the form of the carrier 251, within the holder 252, on which the replacement assembly is hung. In particular, the replacement assembly 250 comprises several layers, each as shown at 253 in FIG. 38 which are intended to be wrapped around the carrier 251, rather than hung over the carrier as in the mop of FIG. 17. The layer 253 shown in FIG. 38 is wider than that of FIG. 19, and is cut into strips from one end only, leaving an uncut portion 254 in the other end. A series of holes 255 is formed in the uncut portion 254 of the layer.

The carrier 251 of the mop shown in FIG. 36 is attached to the body portion 256 of the holder 252 in exactly the same manner as in FIG. 17 and, to that end, is provided with two upstanding clips 257 with hook-shaped ends 258 which click into openings 259 in recesses 260 in the body portion 256. In this case, however, the carrier does not have a centrally-located upstanding socket but is provided with a peripheral skirt 261 on which are formed several outwardly-extending pegs 262 spaced at intervals around the carrier 251.

Figure 39:
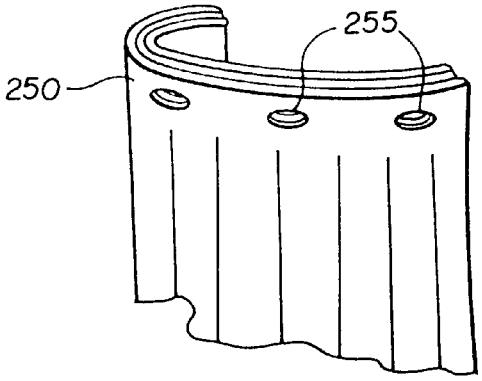
FIG. 39 is a perspective view of a replaceable assembly for the mop of FIG. 36.

To assemble the mop head shown in FIG. 36, several layers 253 are placed one on top of another, as shown in FIG. 39 and then hung around the carrier 251 with the apertures 255 located on the pegs 262. The carrier 251 is then clipped into the body portion 256.

If it is subsequently required to replace the strip assembly 250, the carrier 251 can be released from the body portion 256 in the same manner as in FIG. 17.

Figure 40:
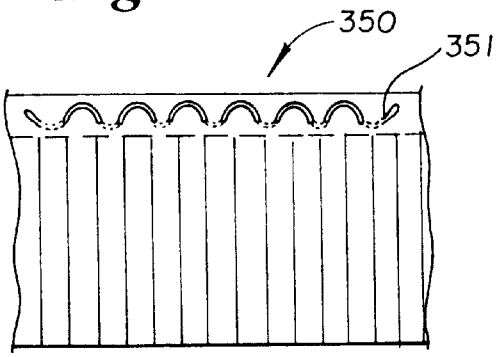
FIGS. 40 to 42 show alternative replacement assemblies for the mop of FIG. 36.
Figure 41:
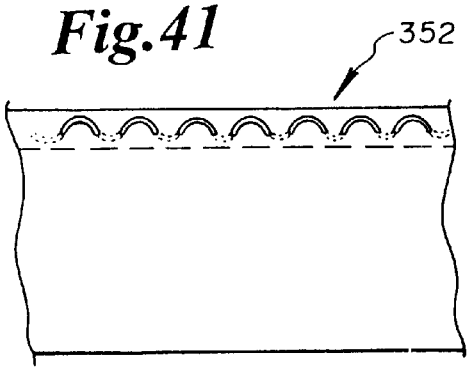
Figure 42:
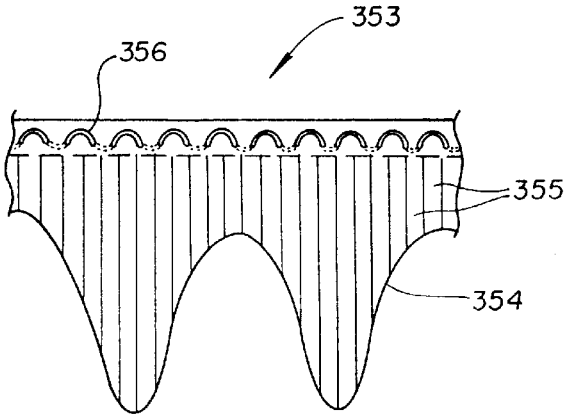

Other replacement assemblies suitable for use in the mop head of FIG. 36 are shown in FIGS. 40 to 42.

Figure 37:
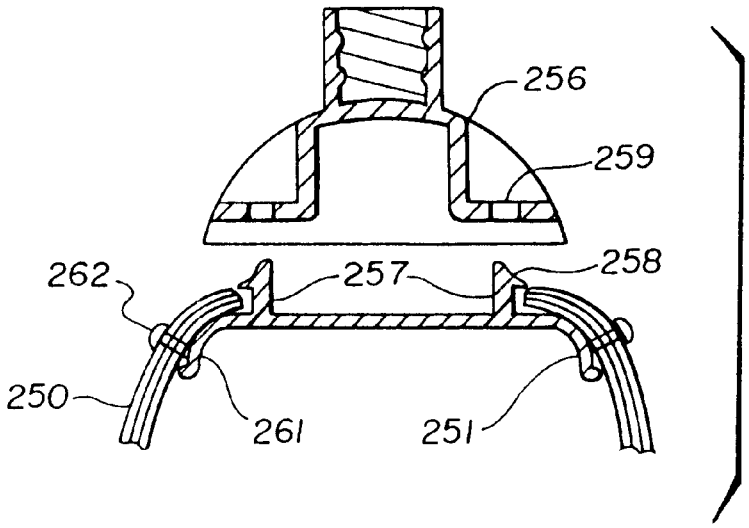
FIG. 37 is an exploded view, partly in cross-section, of the mop shown in FIG. 36.
Figure 38:
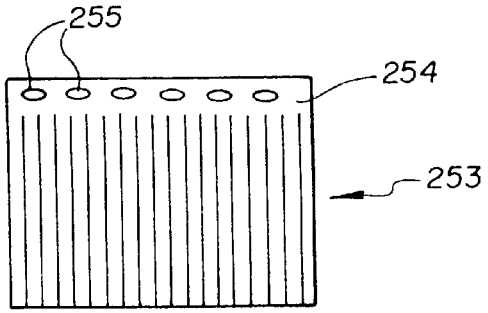
FIG. 38 is a plan view of a layer of a replaceable assembly for the mop of FIG. 36.

FIG. 40 shows a replacement assembly 350 which is generally similar to that shown in FIG. 38 but is substantially longer and is provided with a drawstring heading 351 to enable the assembly to be gathered to a length suitable to fit around the carrier 251 of the mop head (see FIG. 37). The pegs 262 of the carrier 251 would fit into conveniently-located apertures of the drawstring heading 351. The use of such a replacement assembly 350 may make it unnecessary to use several layers of strips 250 as described with reference to FIG. 39.

Figure 43:
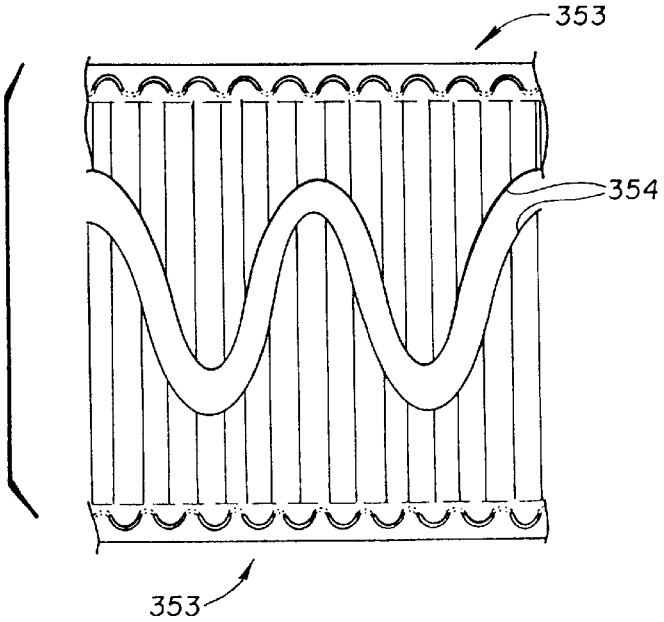
FIG. 43 illustrates a step in the manufacture of the replacement assembly of FIG. 42.

FIG. 41 shows a replacement assembly 3 52 which is similar to that of FIG. 40 but which is not cut into strips, while FIG. 42 shows an assembly 353 which is also similar to that of FIG. 40 but has an undulating edge 354 at the lower end of the strips 355 (i.e. the edge opposite the drawstring heading 356). Despite the more complex shape of the replacement assembly shown in FIG. 42, it is possible to produce such assemblies without increased waste of the web material from which the assemblies are cut. To illustrate how that can be achieved, FIG. 43 shows two assemblies 353 placed end-to-end. It can be seen from FIG. 43 that the undulating edges 354 of the two assemblies fit together and enable the two assemblies to be cut together, either cross-wise or lengthwise of the web material.

Figure 44:
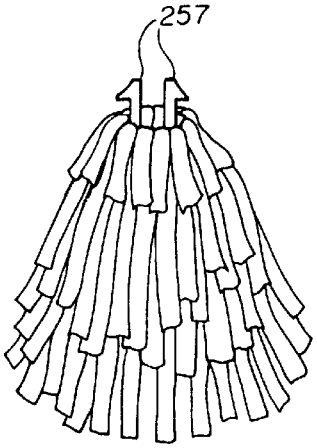
FIG. 44 is a perspective view of part of a mop head incorporating a replacement assembly of the type shown in FIG. 42.

FIG. 44 is a perspective view showing a replacement assembly 353 located on the carrier 251 of FIG. 37, before the carrier is clipped into the body portion 256 of the mop head holder. The pegs 262 of the carrier are located in apertures of the drawstring heading 356 of the replacement assembly and are not visible, but the upstanding clips 257 can be seen. FIG. 44 also shows the visual effect achieved through the use of a replacement assembly having an undulating lower edge.

Figure 45:
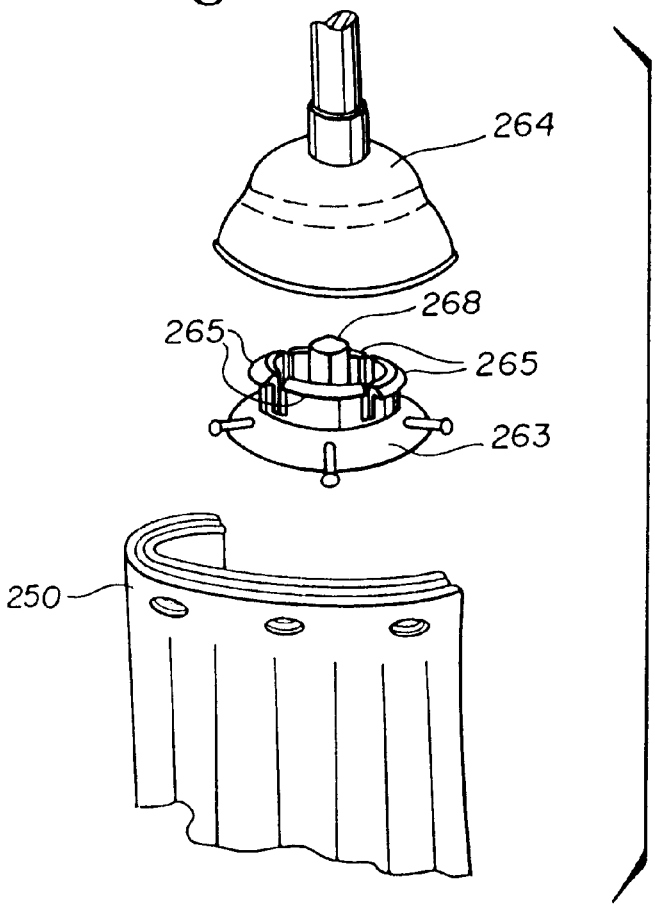
FIG. 45 is an exploded, perspective, view of another modified form of the mop.
Figure 46:
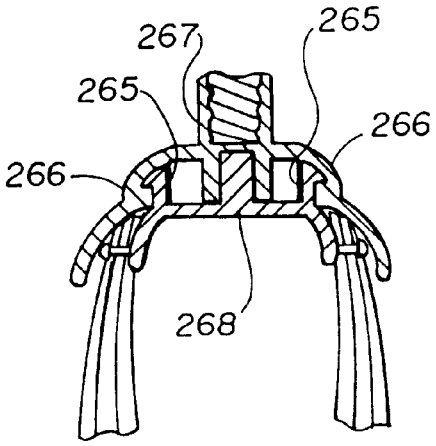
FIG. 46 is a cross-section, similar to FIG. 20, of the head of the mop of FIG. 30, in an assembled condition.

FIGS. 45 and 46 show a further modification of the mop head shown in FIG. 36, in which the strip assembly 250 is as shown in FIG. 36, but the carrier 263 is of a different form, as is the body portion 264 of the holder, into which the carrier 263 is clipped. In this case, the carrier 263 has four upstanding clips 265 which can engage an internal, circumferential latch 266 in the body portion 264. A central upstanding spigot 268, having a rectangular cross-section, engages in a similarly-shaped socket 267 within the body portion 264, and prevents the carrier 263 from rotating within the body portion 264. To release the carrier 263 from the body portion 264, it is necessary only to push the carrier into the body portion (for example. by pressing down on the mop handle) to release the clips 265 from the latch 266 so that the carrier can be withdrawn.

It will be appreciated that any of the replacement assemblies shown in FIGS. 40 to 42 could be used in the mop head shown in FIGS. 45 and 46.

Figure 47:
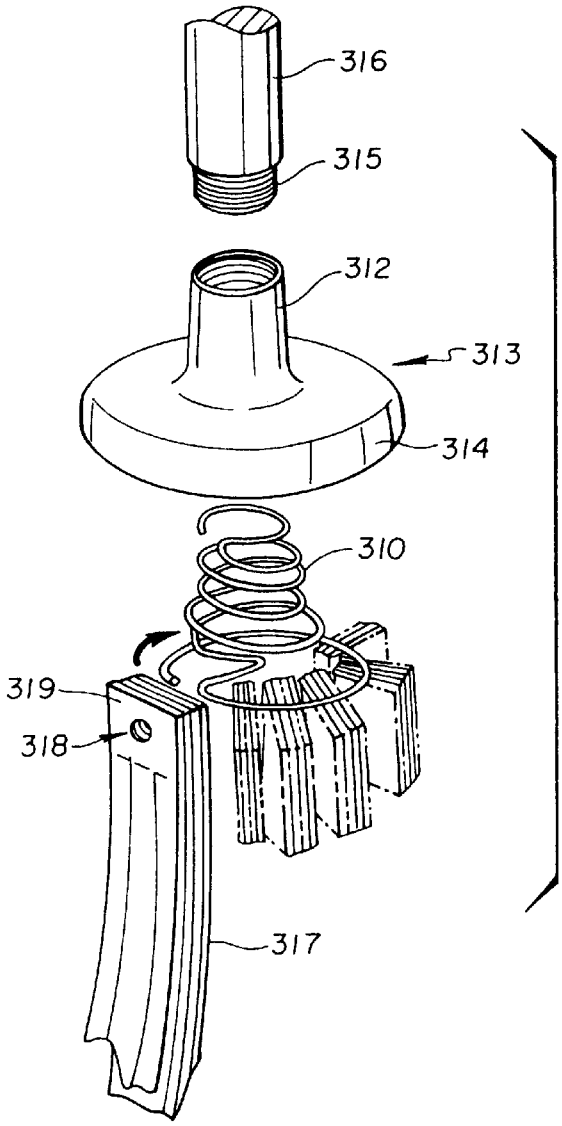
FIG. 47 is a perspective view illustrating another mop in a disassembled condition.
Figure 48:
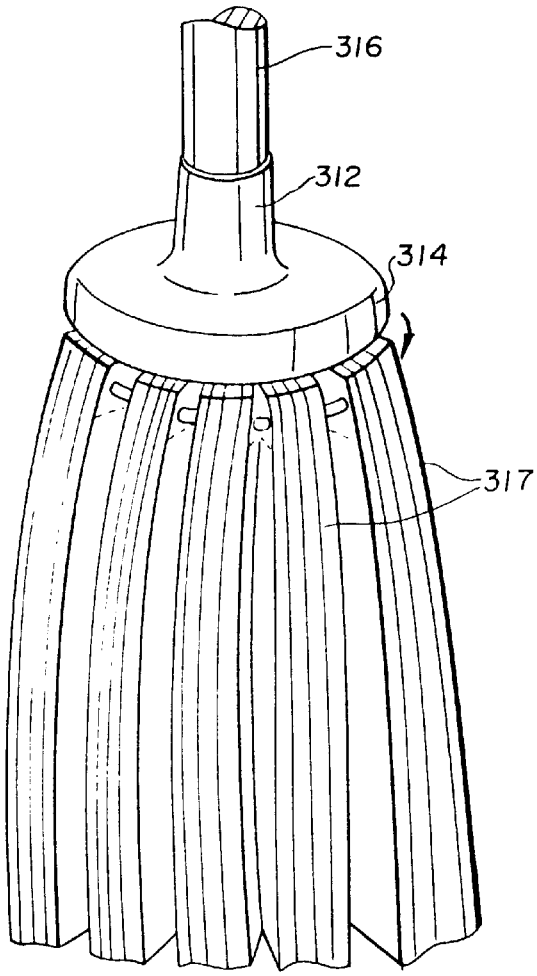
FIG. 48 shows the mop of FIG. 47 in the process of being assembled.

FIGS. 47 and 48 illustrate a mop in which the carrier 310 on which the replacement strips 311 are hung is formed from a stiff wire and is generally coil-shaped. The radius of the turns of the carrier 310 increases from the upper to the lower end: the narrower, upper end of the carrier is intended to fit into a socket-shaped extension 312 of the body 313 of the mop head and the wider, lower end is then located within a flattened dome-shaped part 314 of the body. The extension 312 is threaded internally to receive the coils of the narrower end of the carrier 310, and the latter is then secured in position by screwing the threaded end 315 of the mop handle 316 into the extension 312 as illustrated in FIG. 48.

The replacement strips 317 for the mop of FIGS. 47 and 48 are, generally, of the form shown in FIG. 7 except that there is one hole 318 only in the uncut portion 319, to enable the replacement strips to be hung on the lower turn of the carrier 310. Each layer of strips 317 can be hung individually on the carrier 310 but, preferably, several layers are secured together (for example, by stitching) and hung on the carrier as an assembly. When sufficient strips 317 have been hung on the lower turn of the carrier, a removable stop (not shown) is positioned on the end of the carrier to hold the strips in place, and the carrier is then located in the body 313 so that the peripheral edge of the latter covers the top edge of the strips.

Figure 49:
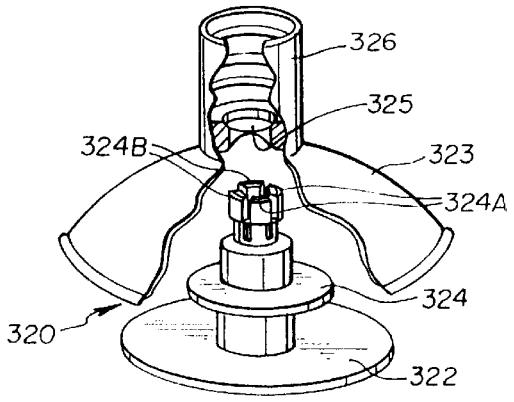
FIG. 49 is an exploded view, partly broken away, of two components of another mop head.
Figure 50:
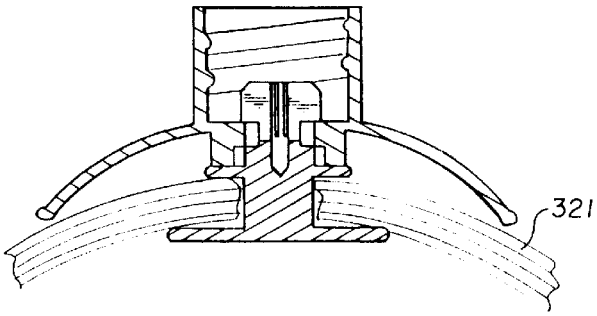
FIG. 50 is a diagrammatic cross-section of a mop head using the components of FIG. 49.
Figure 54:
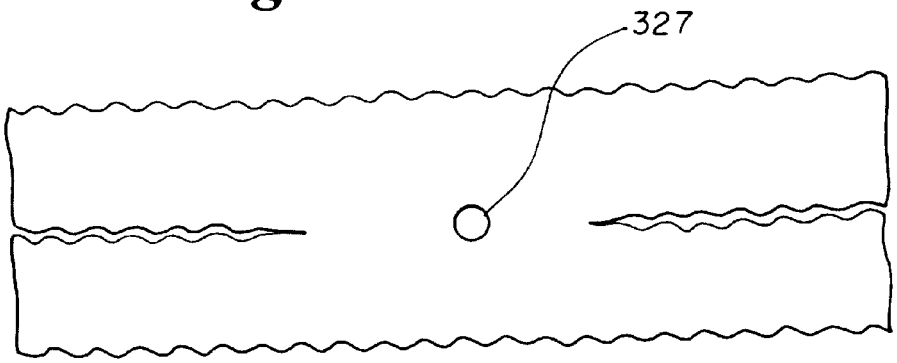
FIGS. 54 to 57 illustrate other forms of replaceable strip assemblies.

FIGS. 49 and 50 show a mop head which is similar to that shown in FIG. 17 in that the carrier 320 over which the replacement strips 321 are hung comprises a flat oval base 322 which is clipped into a dome-shaped body portion 323. In this case, however, the base 322 carries only a central upstanding pin 324, the top of which is shaped to clip into a socket 325 located, in the body portion 323, in the base of the cylindrical extension 326 which receives the mop handle (not shown). The top of the pin 324 is cut into four sections 324*a* which can be compressed together, simply by pulling the carrier 320 away from the body 323, to permit the pin 324 to be removed from the socket 325 and thus allow the carrier 320 to be removed from the body 323. In this case, the replacement strips 321 may be similar to those shown in FIG. 21 but, because only the larger central hole 123 is required, the four surrounding smaller holes 124, 125 can be omitted. Alternatively, the replacement strips may have any other suitable form provided, for example as illustrated in FIG. 54, with a central opening 327 to enable them to be located on the carrier 320. As a further possibility, the strips may have a form which is already known for use in mops in which the strips are not replaceable but are provided with a single opening to enable them to be secured in position in a mop head. For example, U.S. Pat. No. 4,114,224 describes, with reference to FIGS. 1 to 5, various mop strips having a single cross-shaped opening to enable them to be permanently secured in a mophead. Any of those strips would be suitable for use as replacement strips in the mop head illustrated in FIGS. 49 and 50. It will be appreciated that the mop strips can be hung in any orientation.

It will be appreciated that many modifications can be made to the various mop heads shown in the drawings while maintaining, in each case, the possibility of replacing the mop strips without discarding the mop head holder.

Figure 55:
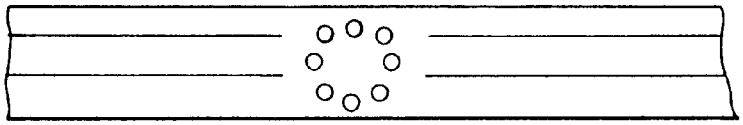

For example, in the mop head holder of FIG. 17, the central upstanding socket 108 on the carrier 107 could be omitted in which case the replacement strips each require only one pair of holes positioned to allow the strips to be located on the upstanding clips 109. In that case, some at least of the strips may have a form which is already known (for example from EP-A-0537 963) for use in a mop in which the strips are not replaceable. Alternatively, the strips may be of the form shown in FIG. 55. Strips of that general form are already known for use in a mop in which the strips are not replaceable, that mop being available under the trade name "Scotch-Brite" from 3M ESPANA, S.A. of Madrid, Spain. The upper surface of the carrier on which the strips are hung may be ridged, to assist in preventing any movement of the strips relative to the carrier.

Figure 56:
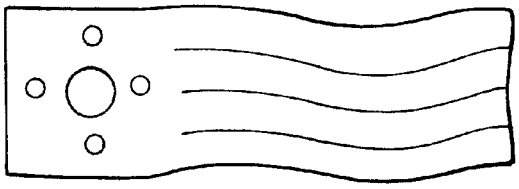

It will be appreciated that the preferred replacement strips for the mop heads of FIGS. 17, 32, 49 and 50 are those which are cut into strips from each end leaving a central, uncut, portion in which holes are formed to enable the strips to be located in the mop head. It is, however, possible to use replacement strips of the general form shown in FIG. 56 (i.e. layers which are cut into strips from one end leaving an uncut portion at the other end in which holes are formed to enable the strips to be located in a mop head). FIG. 56 shows a replacement strip of that type suitable for the mop head of FIG. 17. It will be appreciated that, when replacement strips of that type are used, there will be twice as many layers to be held within the mop head.

Any of the replacement strips shown in FIGS. 19, 38, 47 and 54 to 56 could, as noted above, be cut in the manner illustrated in FIG. 57 or in any other appropriate manner.

The various mops shown in the drawings are intended for domestic use and in particular, for floor cleaning. Mops of similar design could, however, be used for industrial cleaning and for cleaning surfaces other than floors. Moreover, the replaceable assemblies, whether in strip form or otherwise, could be formed from a web material which is suitable for dusting or scouring, rather then washing, surfaces. The possibility thus exists of providing various forms of replaceable assembly for a single mop, each strip assembly being suitable for a particular purpose.

In some cases, the individual layers of material from which a replaceable assembly as formed may be made by laminating together two or more layers of different materials. Depending on the intended use of the mop, it may be desirable for the material of the replaceable assembly to be chemically-treated. For example, in a mop intended for dusting, the material of the replaceable assembly may be treated with an anti-static agent whereas, in a mop intended for use on polished floors, the material of the replaceable assembly may be impregnated with wax. In some cases, it may be desirable to use more than one type of material in the replaceable assembly. For example, to assist in removing difficult stains from floors, it may be advantageous to include one or more layers of an abrasive material, preferably a non-scratch material in the head of a mop. In the case of a mop as shown in FIG. 17, for example, a layer of abrasive material could be included in the replaceable assembly 102 so that it hangs on the outside of the other layers. That abrasive layer need not be cut into strips like the other layers, and need not be as long as those other layers. A suitable material for the abrasive layer is available, under the trade name "Soft Scour", from Minnesota Mining and Manufacturing Company of St. Paul, Minn., U.S.A.

We claim:

1. A mop head holder for attachment to a mop handle, the mop head holder comprising a first part and a second part which are releasably-engageable one within the other to releasably secure, between the first part and the second part, a replaceable assembly comprising a plurality of layers of web material, the second part being shaped for attachment to the mop handle, the first part located within the second part and shaped to carry the replaceable assembly, the second part including a cylindrical extension including an external surface which has a circumferentially-extending rib for engagement in a corresponding groove in a sleeve at one end of a mop handle, to retain the extension in the sleeve, and a radial projection for engagement in an axial slot in the sleeve to prevent rotation of the extension within the sleeve.

2. A mop head assembly comprising:

a sleeve adapted to contact and cover an end of a mop handle extending therethrough, the sleeve having an internal circumferential groove and at least one axial slot formed therein; and a cylindrical extension for clip-on engagement with the sleeve, the external surface of the cylindrical extension having a circumferentially-extending rib for engagement in the circumferential groove in the sleeve, to retain the extension within the sleeve and, substantially-aligned with the rib, at least one radial projection for engagement in the at least one axial slot in the sleeve to prevent rotation of the cylindrical extension within the sleeve, the cylindrical extension further including a socket formed in the extension to receive a sleeve covered mop handle end.

3. A mop head assembly comprising:

a sleeve adapted to contact and cover an end of a mop handle extending therethrough, the sleeve having an internal circumferential groove and an axial slot formed therein; and a cylindrical extension for clip-on engagement with the sleeve, the external surface of the cylindrical extension having a circumferentially-extending rib for engagement in the circumferential groove in the sleeve, to retain the extension within the sleeve and a radial projection for engagement in the axial slot in the sleeve to prevent rotation of the extension within the sleeve, the cylindrical extension further including a socket formed in the extension to receive a sleeve covered mop handle end.

4. A mop comprising a mop head as claimed in claim 3 in combination with a mop handle having a sleeve at one end in which the cylindrical extension on the mop head is a push-fit, the sleeve having an internal groove for receiving the said rib, and an axially-extending slot for receiving the said radial projection.

5. A mop head assembly comprising: a releasable holder, a replaceable assembly supported by said holder, said assembly comprising at least one layer of web material, including a section of elongate strips, and having at least one aperture for locating the layer in the releasable holder which comprises a triangular frame having a base to support the replaceable assembly, the releasable holder being attachable to a mop handle and engaging a sleeve at an end of the mop handle to releasably clamp the replaceable assembly between the releasable holder and the sleeve.

6. A mop head assembly comprising:

a replaceable assembly comprising at least one layer of web material, including a section of elongate strips, and having at least one aperture formed therein; and a releasable holder comprising a generally rectangular body having opposing side ends and including at least one support track formed in the body extending between the side ends parallel to the longitudinal axis of the body and opening to at least one of the opposing side ends to receive an elongate rail for engaging the body and the replaceable assembly to hold the replaceable assembly against the body, the rail being adapted to slide into the support track formed in the body, the rail having a pin to align with the at least one aperture, the releasable holder being attachable to a mop handle extending from the releasable holder at right angles to the longitudinal axes of the generally rectangular body, the support track and the elongate rail.

* * * * *